US010722034B2

(12) United States Patent
Winterhalter et al.

(10) Patent No.: US 10,722,034 B2
(45) Date of Patent: Jul. 28, 2020

(54) PORTABLE CHAIR

(71) Applicant: YETI Coolers, LLC, Austin, TX (US)

(72) Inventors: Andrew J. Winterhalter, Austin, TX (US); Michael Cieszko, Austin, TX (US); Evan Goldberg, Austin, TX (US); Derek G. Sullivan, Austin, TX (US); Donald Edward Desroches, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 13 days.

(21) Appl. No.: 16/247,121

(22) Filed: Jan. 14, 2019

(65) Prior Publication Data

US 2019/0216222 A1 Jul. 18, 2019

Related U.S. Application Data

(60) Provisional application No. 62/638,879, filed on Mar. 5, 2018, provisional application No. 62/617,160, filed on Jan. 12, 2018.

(51) Int. Cl.
*A47C 4/28* (2006.01)
*A47C 4/48* (2006.01)
(Continued)

(52) U.S. Cl.
CPC ..... *A47C 4/286* (2013.01); *A47C 4/30* (2013.01); *A47C 4/32* (2013.01); *A47C 4/38* (2013.01); *A47C 4/42* (2013.01); *A47C 4/48* (2013.01)

(58) Field of Classification Search
CPC ..... A47C 1/0265; A47C 1/14; A47C 1/024; A47C 4/286; A47C 4/20; A47C 4/28;
(Continued)

(56) References Cited

U.S. PATENT DOCUMENTS 2,088,644 A 8/1937 Erpelding et al.
3,736,021 A 5/1973 MacLaren
(Continued)

FOREIGN PATENT DOCUMENTS

BE 484542 A 9/2010
CN 2102679 U 4/1992
(Continued)

OTHER PUBLICATIONS

US 6,214,270 B1, 04/2001, Branum (withdrawn)
Mar. 21, 2019—(PCT) International Search Report and Written Opinion—App PCT/US2019/013511.

*Primary Examiner* — Chi Q Nguyen
(74) *Attorney, Agent, or Firm* — Banner & Witcoff, Ltd.

(57) ABSTRACT

A folding chair can include a seat pan being formed by a pair of seat bars. The seat pan can be tensioned by a pair of vertical legs. The chair can also include a backrest formed by a pair of diagonally extending backrest bars, a front frame formed by a pair of cross bars, a rear frame formed by rear cross bars, and a pair of armrests. In one example, the seat pan and the backrest can be formed of a suspension fabric. The vertical legs can each be provided with a lower leg and an upper leg. The inner leg can be configured to telescope out of the outer leg and at least one of the vertical legs can be provided with a latch for locking the outer leg to the inner leg. The latch can include a rocker and a projection can be configured to rotate the projection out of a slot formed in the inner leg. The backrest can be provided with a tensioner for maintaining the backrest in the unfolded position. The tensioner can include a pair of linkages, and an insert can be configured to hold the pair of linkages in a tensioned position.

18 Claims, 38 Drawing Sheets

(51) Int. Cl.

| | |
|---|---|
| ***A47C 4/30*** | (2006.01) |
| ***A47C 4/38*** | (2006.01) |
| ***A47C 4/32*** | (2006.01) |
| ***A47C 4/42*** | (2006.01) |

(58) Field of Classification Search

CPC .... A47C 4/30; A47C 4/32; A47C 4/38; A47C 4/42; A47C 4/48; A47C 5/10; A47C 7/54

USPC .. 297/28, 35, 42, 16.1, 16.2, 20, 56, 55, 45, 297/46, 47

See application file for complete search history.

(56) References Cited

U.S. PATENT DOCUMENTS

| | | | | |
|---|---|---|---|---|
| 3,881,739 | A | 5/1975 | Laune | |
| 4,029,279 | A | 6/1977 | Nakatani | |
| 4,077,641 | A | 3/1978 | Perego et al. | |
| 4,122,227 | A | 10/1978 | Dean | |
| 4,216,974 | A | 8/1980 | Kassai | |
| 4,232,897 | A | 11/1980 | Maclaren et al. | |
| 4,335,893 | A | 6/1982 | Carmichael et al. | |
| 4,469,739 | A | 9/1984 | Gretzinger et al. | |
| 4,545,599 | A | 10/1985 | Kassai | |
| 4,596,484 | A | 6/1986 | Nakatani | |
| 4,761,092 | A | 8/1988 | Nakatani | |
| 4,932,622 | A | 6/1990 | Hayakawa | |
| 5,058,950 | A * | 10/1991 | Mann | A47C 4/286 297/16.2 |
| 5,106,678 | A | 4/1992 | Abu-Isa | |
| 5,348,415 | A | 9/1994 | Carlsson | |
| 5,397,627 | A | 3/1995 | Dunbar et al. | |
| 5,769,447 | A | 6/1998 | Huang | |
| 5,775,352 | A | 7/1998 | Obitts | |
| 5,851,052 | A | 12/1998 | Gustafsson | |
| 5,863,061 | A | 1/1999 | Ziegler et al. | |
| 5,888,915 | A | 3/1999 | Denton et al. | |
| 5,955,385 | A | 9/1999 | Schobesberger et al. | |
| 6,082,813 | A * | 7/2000 | Chen | A47C 4/286 297/16.1 |
| 6,247,749 | B1 | 6/2001 | Yu | |
| 6,270,156 | B1 | 8/2001 | Metzger et al. | |
| 6,287,690 | B1 | 9/2001 | Land | |
| 6,371,553 | B1 | 4/2002 | Tang | |
| 6,402,230 | B1 | 6/2002 | Tang | |
| 6,419,311 | B1 | 7/2002 | Tang | |
| 6,536,723 | B1 | 3/2003 | Nakatani | |
| 6,598,841 | B2 | 7/2003 | Erickson et al. | |
| 6,629,722 | B1 | 10/2003 | Tang | |
| 6,644,731 | B2 | 11/2003 | Tang | |
| 6,705,070 | B2 | 3/2004 | Schwartz | |
| 6,840,574 | B1 | 1/2005 | Wu | |
| 6,869,679 | B1 | 3/2005 | Negola | |
| 6,908,249 | B2 | 6/2005 | Tomm | |
| 6,913,231 | B2 | 7/2005 | Speggiorin | |
| 7,017,985 | B2 | 3/2006 | Chen | |
| 7,100,975 | B1 | 9/2006 | Zheng | |
| 7,157,388 | B2 | 1/2007 | Langley et al. | |
| 7,201,024 | B2 | 4/2007 | Hirayama et al. | |
| 7,247,585 | B2 | 7/2007 | Bascom et al. | |
| 7,300,691 | B2 | 11/2007 | Callaway et al. | |
| 7,458,642 | B1 | 12/2008 | Spicer | |
| 7,500,715 | B1 | 3/2009 | Chen | |
| 7,641,276 | B1 | 1/2010 | Chen | |
| 7,682,994 | B2 | 3/2010 | Van Emden et al. | |
| 7,696,110 | B2 | 4/2010 | Taniguchi et al. | |
| 7,851,390 | B2 | 12/2010 | Salzmann et al. | |
| 7,887,131 | B2 | 2/2011 | Chadwick et al. | |
| 7,892,989 | B2 | 2/2011 | Schwartz et al. | |
| 8,100,429 | B2 | 1/2012 | Longenecker et al. | |
| 8,104,838 | B2 | 1/2012 | Tsai | |
| 8,207,071 | B2 | 6/2012 | Susa et al. | |
| 8,251,442 | B2 * | 8/2012 | Grace | A47C 4/286 297/16.2 |
| 8,459,741 | B2 | 6/2013 | Mazzola et al. | |
| 8,460,790 | B2 | 6/2013 | Ochi et al. | |
| 8,506,865 | B2 | 8/2013 | Wangenheim | |
| 8,678,490 | B2 * | 3/2014 | Chen | A47C 4/283 297/36 |
| 8,696,052 | B2 * | 4/2014 | Zhu | A47C 4/28 297/36 |
| 8,727,655 | B2 | 5/2014 | Lu et al. | |
| 8,820,825 | B2 | 9/2014 | Yang | |
| 8,864,222 | B2 | 10/2014 | Grace | |
| 8,979,192 | B2 | 3/2015 | Miller | |
| 9,095,216 | B2 | 8/2015 | Miller | |
| 9,121,131 | B2 | 9/2015 | Underwood et al. | |
| 9,315,926 | B2 | 4/2016 | Date et al. | |
| 9,451,829 | B2 | 9/2016 | Chen | |
| 9,545,773 | B2 | 1/2017 | Hansen | |
| 9,771,675 | B2 | 9/2017 | Altshuler et al. | |
| 9,974,388 | B1 * | 5/2018 | Lv | A47C 4/42 |
| 9,993,082 | B2 | 6/2018 | Choi | |
| 9,993,083 | B2 | 6/2018 | Choi | |
| 10,104,971 | B1 * | 10/2018 | Yang | A47C 7/462 |
| 10,292,503 | B2 * | 5/2019 | Brown | A47C 1/14 |
| 2003/0025361 | A1 | 2/2003 | Liu | |
| 2009/0174230 | A1 * | 7/2009 | Chen | A47C 4/286 297/16.1 |
| 2010/0171342 | A1 * | 7/2010 | Chen | A47C 4/283 297/45 |
| 2010/0314914 | A1 | 12/2010 | Mazzola et al. | |
| 2014/0097647 | A1 * | 4/2014 | Grace | A47C 3/025 297/42 |
| 2014/0217784 | A1 | 8/2014 | Chen | |
| 2014/0227474 | A1 | 8/2014 | Cramer | |
| 2015/0038040 | A1 | 2/2015 | Gabbay | |
| 2015/0360159 | A1 | 12/2015 | Lee et al. | |
| 2016/0081479 | A1 | 3/2016 | Lin | |
| 2016/0100688 | A1 * | 4/2016 | Grace | A47C 4/286 297/17 |
| 2016/0135600 | A1 | 5/2016 | Chen | |
| 2017/0202355 | A1 | 7/2017 | Reed | |
| 2018/0002839 | A1 | 1/2018 | Liao et al. | |
| 2018/0073169 | A1 | 3/2018 | Chou | |
| 2018/0245248 | A1 | 8/2018 | Buffington et al. | |
| 2019/0090667 | A1 | 3/2019 | Mason et al. | |
| 2019/0216222 | A1 | 7/2019 | Winterhalter et al. | |

FOREIGN PATENT DOCUMENTS

| | | | |
|---|---|---|---|
| CN | 201001527 | Y | 1/2008 |
| CN | 201492050 | U | 6/2010 |
| CN | 301297394 | | 8/2010 |
| CN | 102230248 | A | 11/2011 |
| CN | 301800654 | | 1/2012 |
| CN | 202236165 | U | 5/2012 |
| CN | 202515069 | U | 11/2012 |
| CN | 202858412 | U | 4/2013 |
| CN | 104643681 | A | 5/2015 |
| CN | 105615364 | A | 6/2016 |
| CN | 106617546 | A | 5/2017 |
| CN | 107348734 | A | 11/2017 |
| CN | 207349221 | U | 5/2018 |
| CN | 207421059 | U | 5/2018 |
| CN | 207653880 | U | 7/2018 |
| CN | 208708874 | U | 4/2019 |
| DE | 1080176 | B | 4/1960 |
| DE | 1267945 | B | 5/1968 |
| EP | 2108284 | A1 | 10/2009 |
| EP | 2123198 | A1 | 11/2009 |
| EP | 2145036 | A1 | 1/2010 |
| EP | 2674629 | A2 | 12/2013 |
| ES | 279347 | A1 | 1/1963 |
| JP | 2010099238 | A | 5/2010 |
| JP | D1550241 | | 5/2019 |
| JP | D1550242 | | 5/2019 |
| KR | 300686541.0000 | | 3/2013 |
| KR | 20170099158 | A | 8/2017 |
| KR | 300993887.0000 | | 2/2019 |
| NL | 1001847 | C1 | 6/1997 |
| WO | 0040122 | A1 | 7/2000 |

(56) References Cited

FOREIGN PATENT DOCUMENTS

| | | | |
|---|---|---|---|
| WO | 13029089 | A1 | 3/2013 |
| WO | 2016150254 | A1 | 9/2016 |
| WO | 17133369 | A1 | 8/2017 |

* cited by examiner

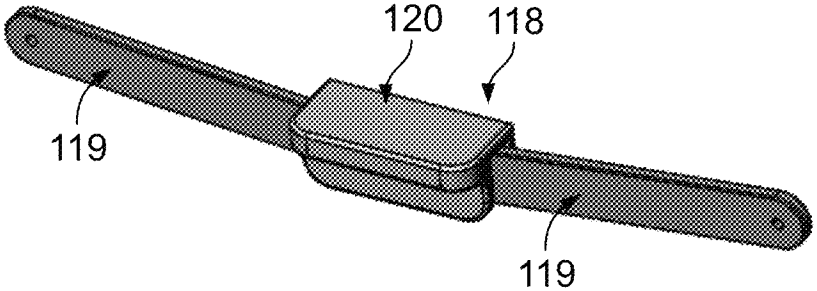
FIG. 12A2
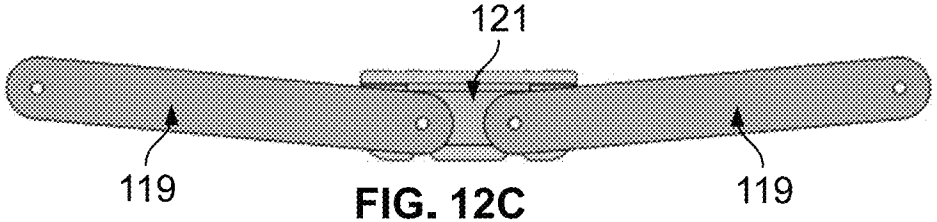
FIG. 12C
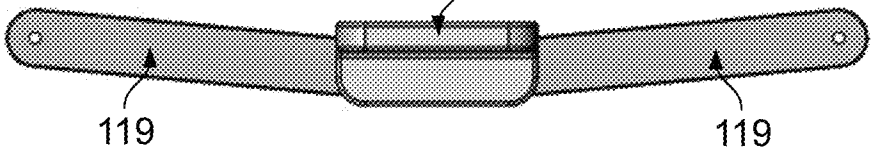
FIG. 12D
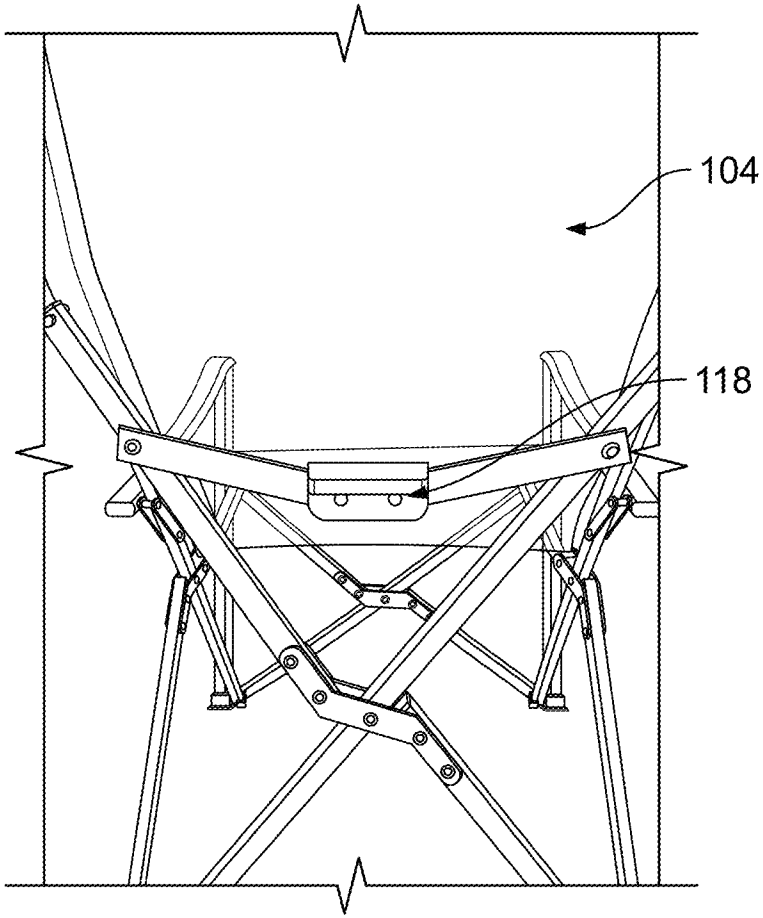
FIG. 12A1

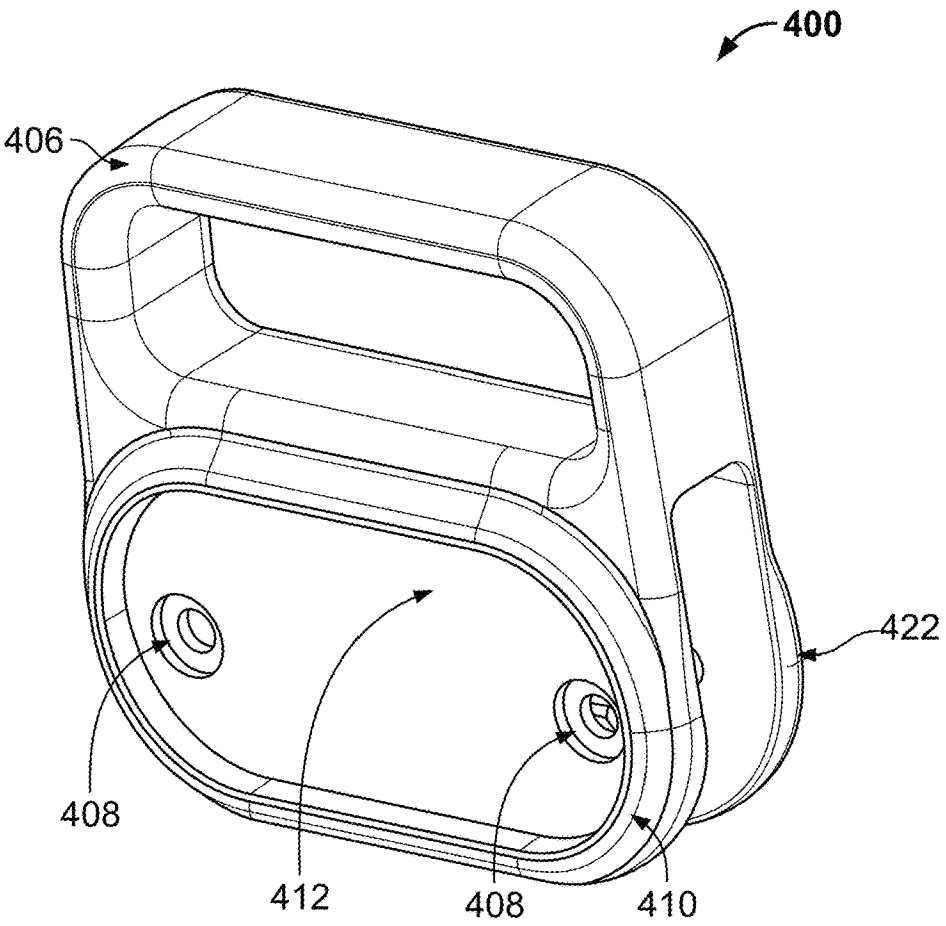
FIG. 24A
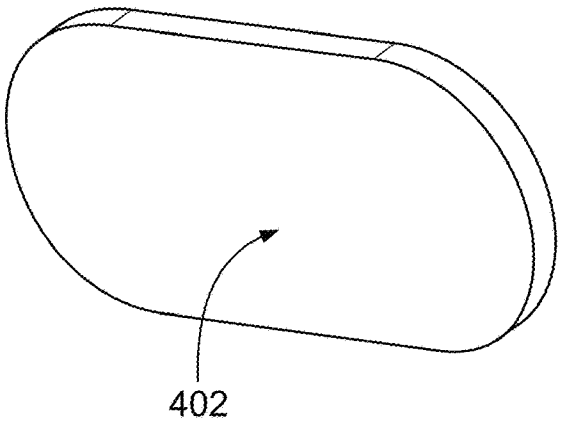

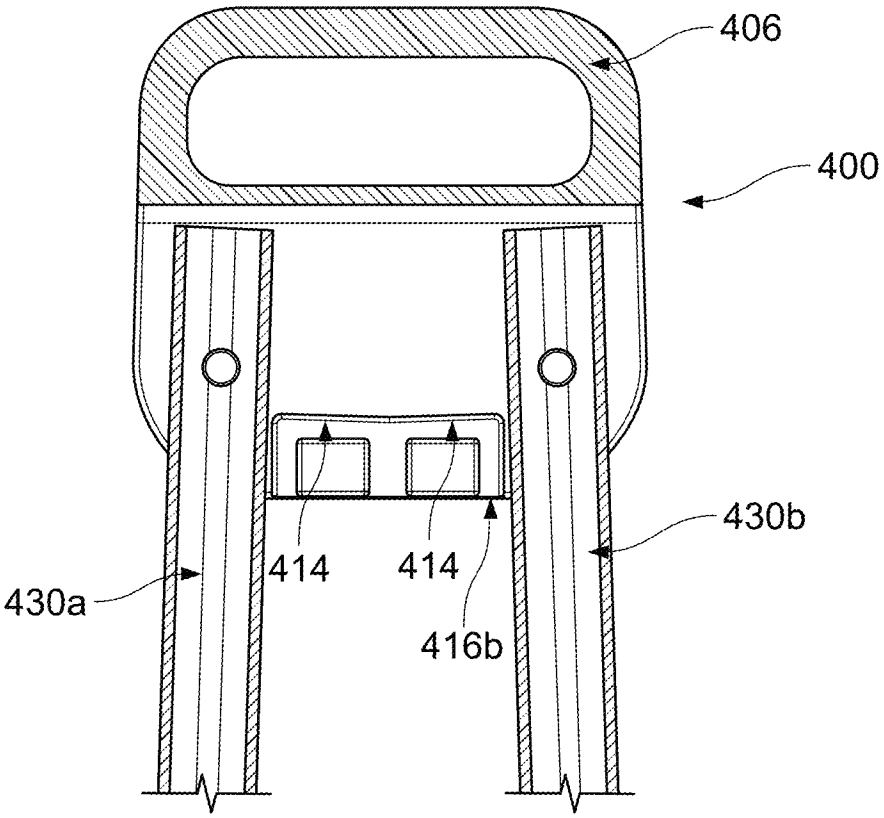
FIG. 28
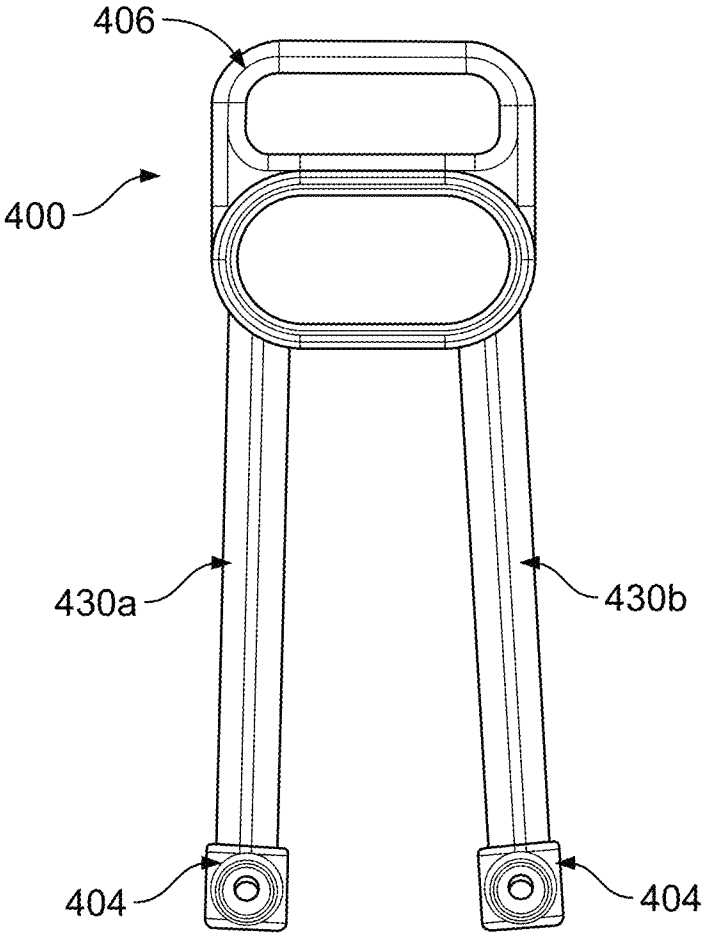

PORTABLE CHAIR

CROSS REFERENCE TO RELATED APPLICATIONS

This application claims the benefit U.S. Provisional Patent Application No. 62/617,160, filed on Jan. 12, 2018, and U.S. Provisional Application No. 62/638,879, filed on Mar. 5, 2018; each of which are hereby incorporated by reference in their entireties.

BACKGROUND

Folding chairs are a very popular seating option. Such chairs may be used everywhere from spectator sports on the sidelines to camping in woods. Although they are affordable to a large part of the population, the affordability often means that the best materials are not always used in the construction of the chairs. In some instances, folding chairs can be slung over the user's shoulder and carried by the user. Also in some instances, folding chairs may have certain pressure points on the seating surface, which can be uncomfortable to the user. Additionally, certain folding chairs may require the weight of the user to keep the folding chairs in the opened position. For instance, once the user gets out of the chair and tries to move it, the chair may awkwardly fold up. In addition, certain chairs may have a particular fabric that fades in color or appearance over time.

BRIEF SUMMARY

This Summary provides an introduction to some general concepts relating to this disclosure in a simplified form that are further described below in the Detailed Description. This Summary is not intended to identify key features or essential features of the invention.

Aspects of the disclosure pertain to folding chairs and locking mechanisms for folding chairs.

In some examples, the folding chairs may include a seat pan formed by a pair of seat bars.

The seat pan may be tensioned by a pair of vertical legs. In some examples, the folding chair may also include a backrest that is formed by a pair of diagonally extending backrest bars. In other examples the folding chair may include a front frame formed by a pair of cross bars, and a rear frame formed by rear cross bars. In still other examples, the folding chair may include a pair of armrests. In other examples, the seat pan and the backrest are formed of a suspension fabric. In some examples, the suspension fabric may be constructed of a first yarn, a second yarn, and a thermoplastic polyurethane film. In other examples the first yarn may be a polymer and the second yarn may be more elastomeric than the first yarn, and the thermoplastic polyurethane film can be heat pressed to the first yarn and second yarn.

In some arrangements, the folding chairs may include vertical legs that are provided with a lower leg or lower tube and an upper leg or upper tube, and the inner leg or inner tube is configured to telescope out of the outer leg or outer tube. In yet other examples, at least one of the vertical legs is provided with a latch for locking the outer leg to the inner leg. In still other examples, the latch included a rocker and a projection configured to rotate the projection out of a slot formed in the inner leg. In other examples, the backrest may include a tensioner for maintaining the backrest in an unfolded position. In some examples, the tensioner may include a pair of linkages and an insert configured to hold the pair of linkages in a tensioned position. In other examples, the backrest may include a tensioner configured to maintain the backrest in an unfolded position or a tensioned position, and the tensioner may further include a rear tensioner handle and a pair of tensioner arms.

In still other arrangements, the folding chair includes a latch that also includes a first biasing member configured to maintain the projection in the slot of the inner leg. In other examples, folding chair includes a tensioner with a pair of pivots for linkages and a pair of pins for receiving notches located in the linkages when the linkages are in the tensioned position. In another example, the tensioner also includes a release mechanism, and the release mechanism further includes a pair of angled slots for receiving the pair of pins. The angled slots may be angled such that when the user presses the release mechanism, the pins move away from the receiving notches allowing the linkages to rotate and the backrest to become un-tensioned.

In some examples, the folding chair includes a seat that includes a flange that is configured to both receive a second biasing element and to engage the insert, and the basing element, through the flange, places the insert in a release position. In other examples, receiving notches are located at proximal ends of the linkages. In other examples, angled slots are positioned at approximately 45 degrees from a plane defined by a lower portion of the tensioner. In yet other examples, the angled slots are symmetrically placed on the release mechanism. In other examples, the insert includes a pair of insert slots, and the insert slots may be configured to receive the pins, and located inward on the insert, and the pivots may be located outward of the insert slots. In some examples, the insert may include slots for receiving pins on the pair of linkages and a notch may be configured to receive a boss on at least one of the pair of linkages, and the user may slide a release mechanism to release the tensioner.

In other examples, the rear tensioner may include at least one internal stop and a plurality of pivot points. In still other examples, the rear tensioner may also include a safety gap between a bottom of the rear tensioner handle and the rear tensioner arms. In another example, the tensioner further comprises a safety gap between a surface within the tensioner and one of the rear tensioner arms. In other examples, the rear tensioner arms each include a cam guided in slots defined in a tensioner housing. And during release of the tensioner, the slots can limit the movement of the tensioner arms to maintain the safety gap. In still other examples, the tensioner defines a housing having a pair of pivots for receiving the tensioner arms in which the pair of pivots are located internally within the housing such that the pivots are not exposed to the user. In some examples, the tensioner is configured to engage in the tensioned position when a user applies an increasing downward force to the rear tensioner handle until the tensioner exceeds an over-center point and contacts the stop. In other examples, the tensioner is configured to disengage the tensioned position when a user applies an increasing upward force to the rear tensioner handle until the tensioner exceeds an over-center point and the tensioner is disengaged from the tensioned position into a folded position. In yet other examples, when the tensioner is in the tensioned position, the pair of tensioner arms form a bottom angle greater than 180 degrees and a top angle less than 180 degrees. In certain examples, the tensioner is retained in the tensioned position solely by the suspension fabric. In some examples, the backrest includes a tensioner configured to maintain the backrest in the unfolded position or a tensioned position.

In some examples, the folding chair may include a backrest formed of a suspension fabric, and the suspension fabric may include an overlap containing a core in the overlap. In other examples, the overlap includes a hollow section and the core is placed into the hollow section. The core in the overlap hollow section may be secured in a notch asymmetrically located in the top of the pair of diagonally extending backrest bars. In other examples, the suspension fabric may be constructed of a first yarn, a second yarn, and a thermoplastic polyurethane film. In some examples, the first yarn may be a polymer and the second yarn may be more elastomeric than the first yarn. In still other examples, the thermoplastic polyurethane film may be heat pressed to the first yarn and second yarn. In certain examples, the tensioner comprises a pair of arcuate slots and a pair of arms each having a projection or rivet in which the arcuate slots limit the movement of the pair of arms such that the pair of arms and a surface within the housing define a safety gap on the tensioner. In some examples, the tensioner may also include a pair of stops in which the suspension fabric solely biases the pair of arms against the pair of stops.

These and various other features will be described more fully herein.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

FIG. 12A1 shows a rear view of another example chair with a backrest locking mechanism;

FIGS. 12A2-12D show various views of the locking mechanism of FIG. 12A1;

FIG. 24A illustrates the backrest tensioning mechanism rear tensioner with the rear tensioner cover separated from the rear tensioner.

FIG. 28 illustrates a rear perspective and cross-section view of the rear tensioner in the folded position;

and

Figure 33B:
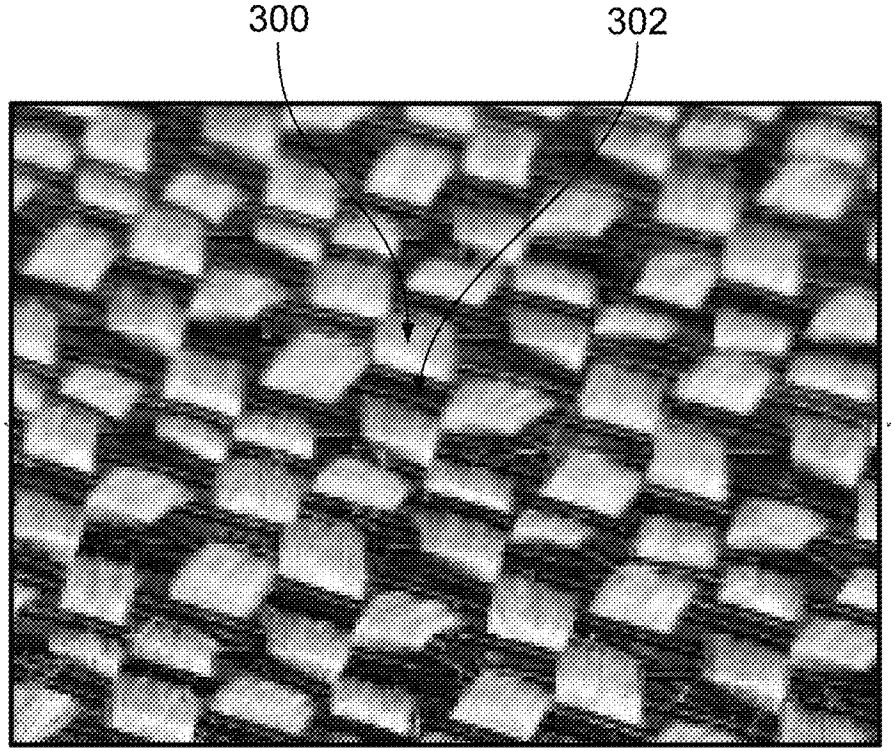
Figure 33A:
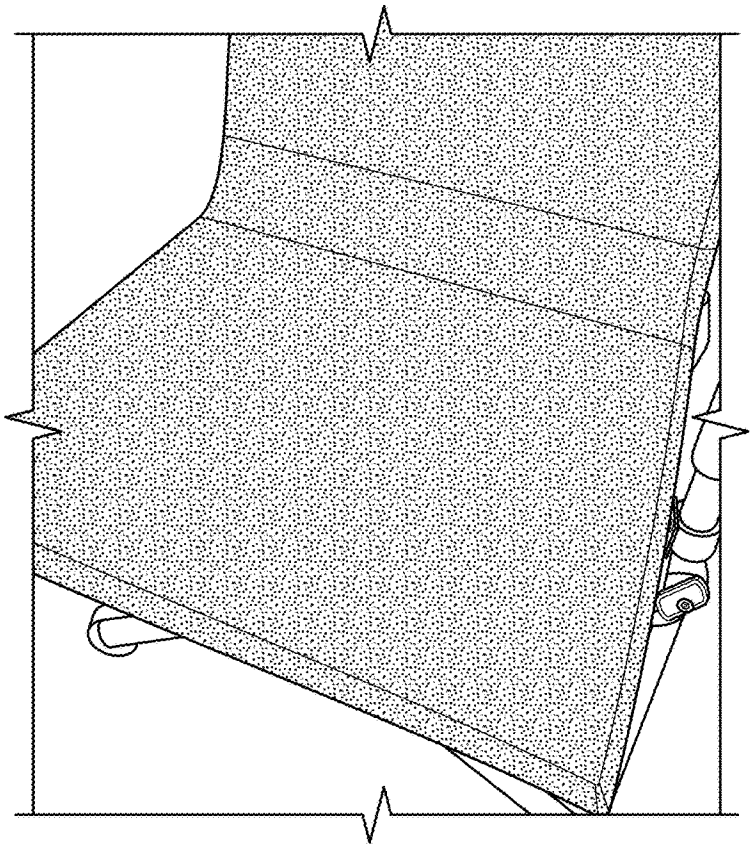
Figure 33C:
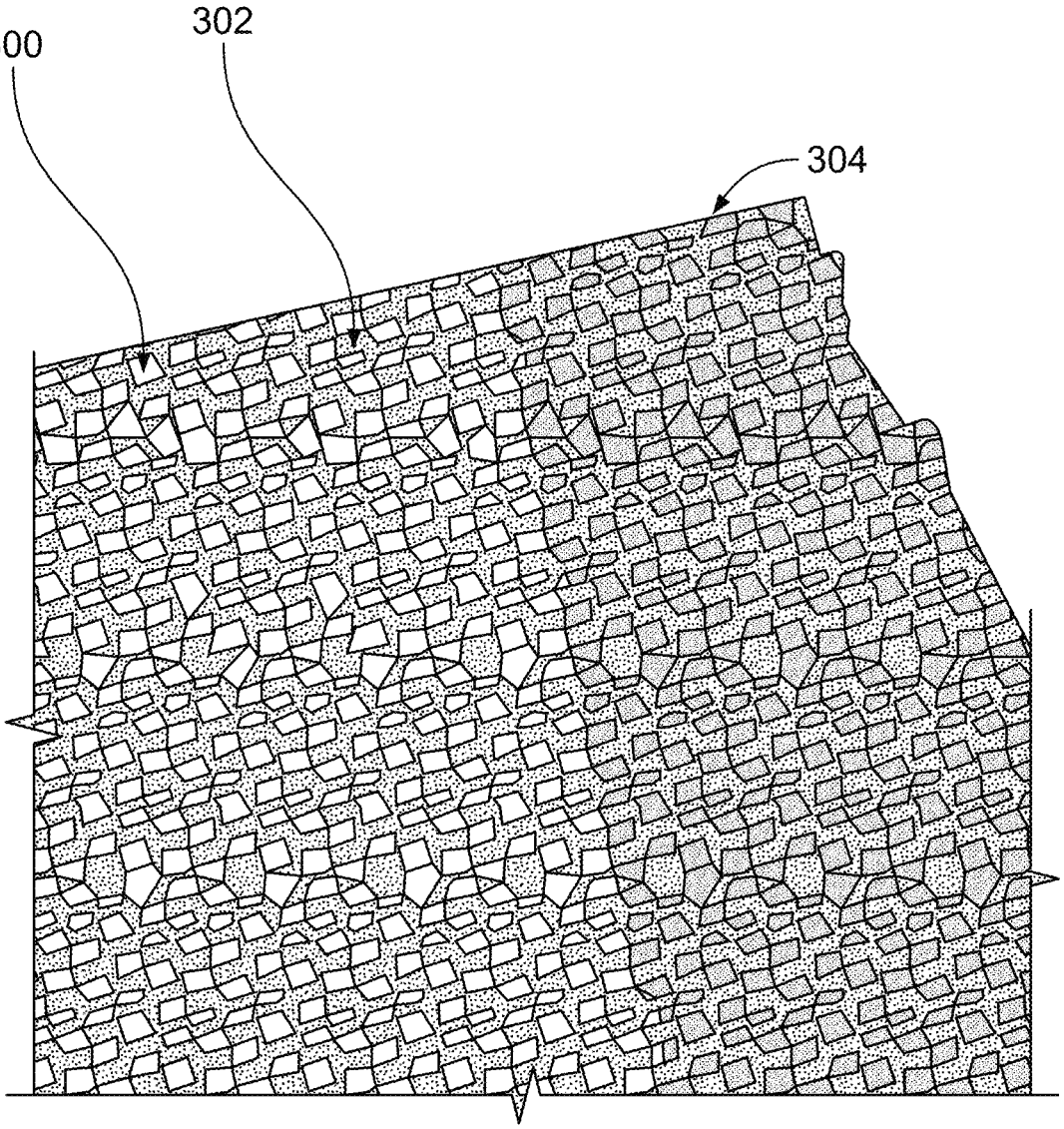

FIGS. 33A-33C illustrate the construction and materials of an example suspension fabric.

Further, it is to be understood that the drawings may represent the scale of different components of one single embodiment; however, the disclosed embodiments are not limited to that particular scale.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

FIG. 1-6 show an example chair. The chair 100 may include a seat pan 102 and a backrest 104. In one example, the seat pan 102 and the backrest 104 can be formed of an elastomeric suspension fabric 155 that is tensioned when the chair is in the unfolded position. When the user sits in the chair 100 the fabric conforms to their body and creates a comfortable seating surface that does not create any pressure points. Additionally, the seat pan 102 is tensioned by vertical legs 106.

The seat pan 102 can be formed by a pair of seat bars 150, which are connected together by an upper fabric 155. In one example, the lower fabric 155*a* can be provided with slots for receiving a core and the core can be placed into channels formed in the seat bars 150. The backrest can be formed by a pair of diagonally and/or parallel extending backrest bars 152. The upper fabric 155 can be provided with slots for receiving a core, and the core can be placed into asymmetrical channels formed in the backrest bars 152. The backrest bars 152 can extend to lower portions of the vertical legs 106 and front cross-bars 142, 144 the front of the chair 100. In certain examples, the fabric of the chair can be formed of an elastomeric suspension fabric is that is made to be UV resistant, which makes the chair less likely to fade over time.

In certain examples, the seat pan 102 suspension material and/or the backrest 104 suspension material may be elastomeric. In other examples, the seat pan 102 suspension material and/or the backrest 104 suspension material may be constructed of a weaved material with yarn having elastomeric properties. The elastomeric properties include the ability to stretch and deform under stress (i.e., increased elasticity), such as tension or weight. The elastomeric properties allow the suspension material to return to its original form and the ability to resist creep and/or permanent deformation when the stress from the load is removed. In one example, as shown in FIGS. 33A and 33B, the suspension material can be formed as a first yarn 300, which can be formed of an acrylic or polymer and blends thereof, and a second yarn 302 that can be formed of an elastomeric material such that the second yarn is more elastomeric than the first yarn. The elastomeric properties of the second yarn can help to provide the elastomeric properties of the suspension material discussed above.

In still other examples, as shown in FIG. 33C, the seat pan 102 suspension material and/or the backrest 104 suspension material may also include a thermoplastic polyurethane film (TPU) 304 that is heat pressed to one or both sides of the suspension material. For example, the TPU 304 can be added to the top side of the fabric, the bottom side of the fabric, or both sides of the fabric after the yarns are weaved. In yet other examples, the seat pan 102 suspension material and/or the backrest 104 suspension material may also include a TPU film heat pressed to the first polymer yarn and the second yarn, after the yarns are weaved. The addition of a TPU film heat pressed to the suspension material may be advantageous in certain applications. For example, the addition of TPU may create a mechanical bond that is resistant to combing and fraying once the material is sewn together and extend the life of the suspension material. In some examples, the TPU film may have a thickness of at least 0.1 mm, 0.02 mm, 0.03, 0.04 mm 0.05 mm, 0.06 mm, 0.07 mm, 0.08 mm, 0.09 mm, or 0.10 mm thick. In still other examples, the TPU layer or film may be substituted with any elastomeric material that has a melting point lower than the first and second yarn to allow the material to be heat pressed to the suspension fabric after the yarns are weaved.

Figure 1:
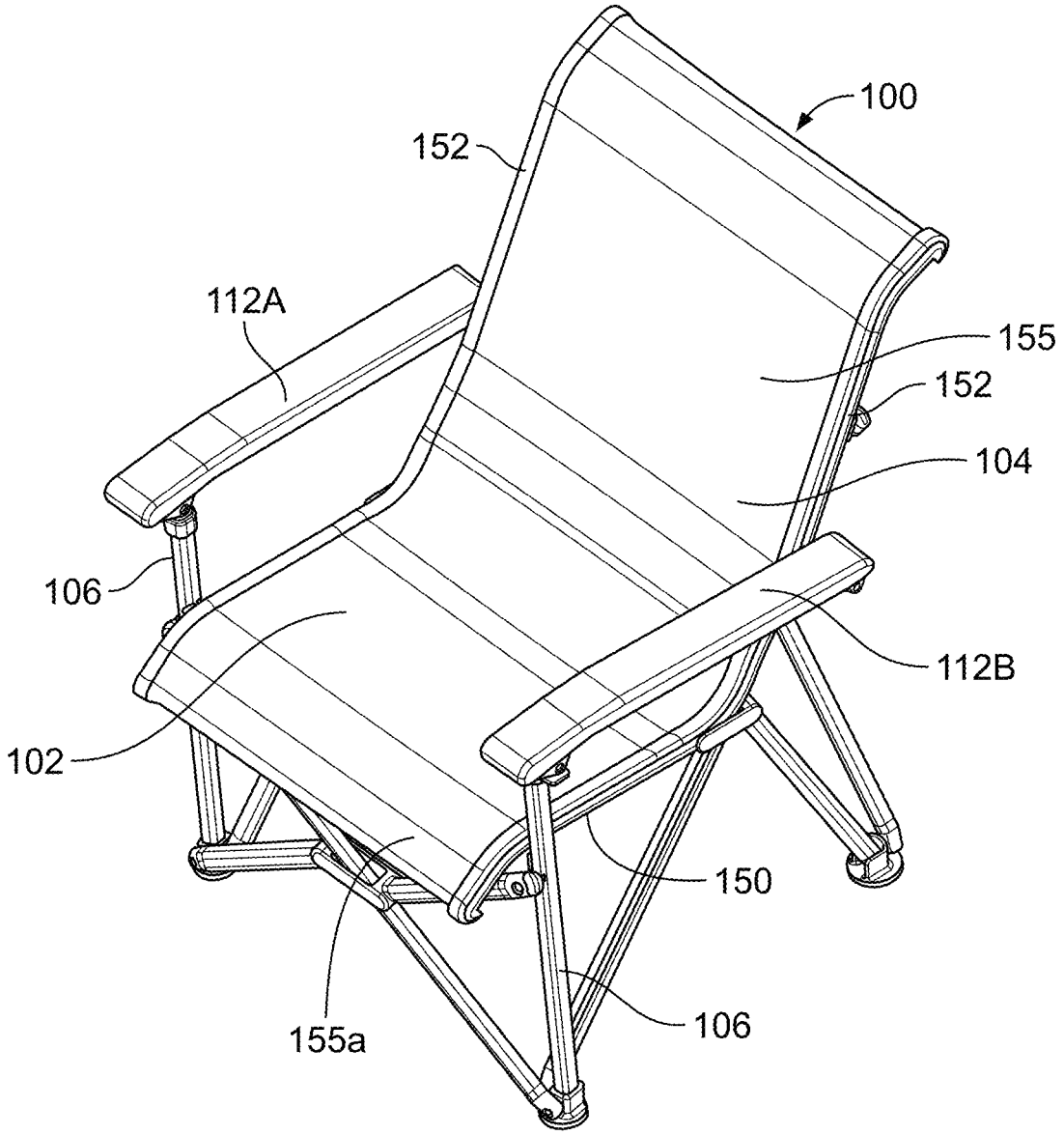
FIGS. 1-6 show various views of an example folding chair.
Figure 2:
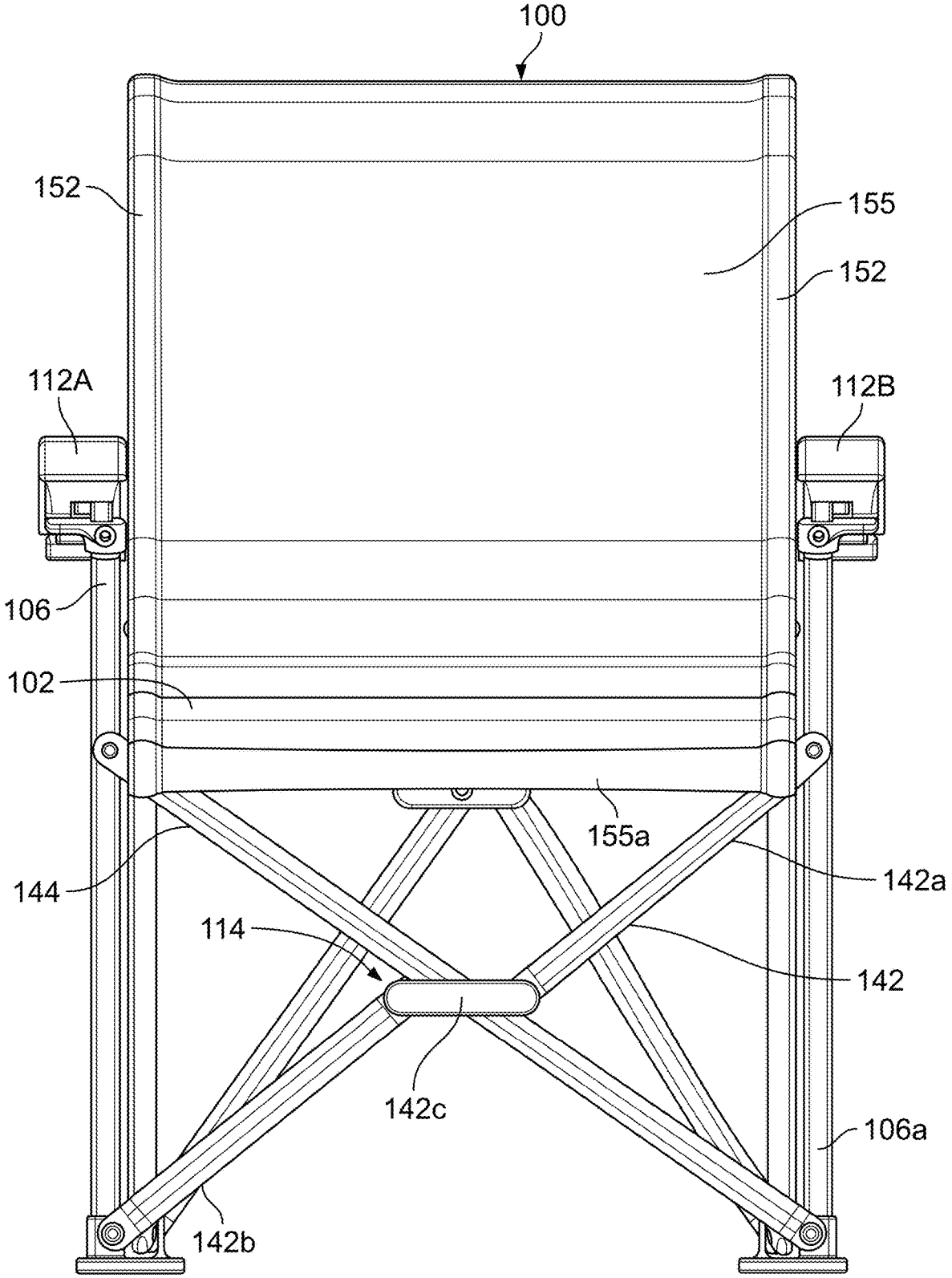
Figure 4:
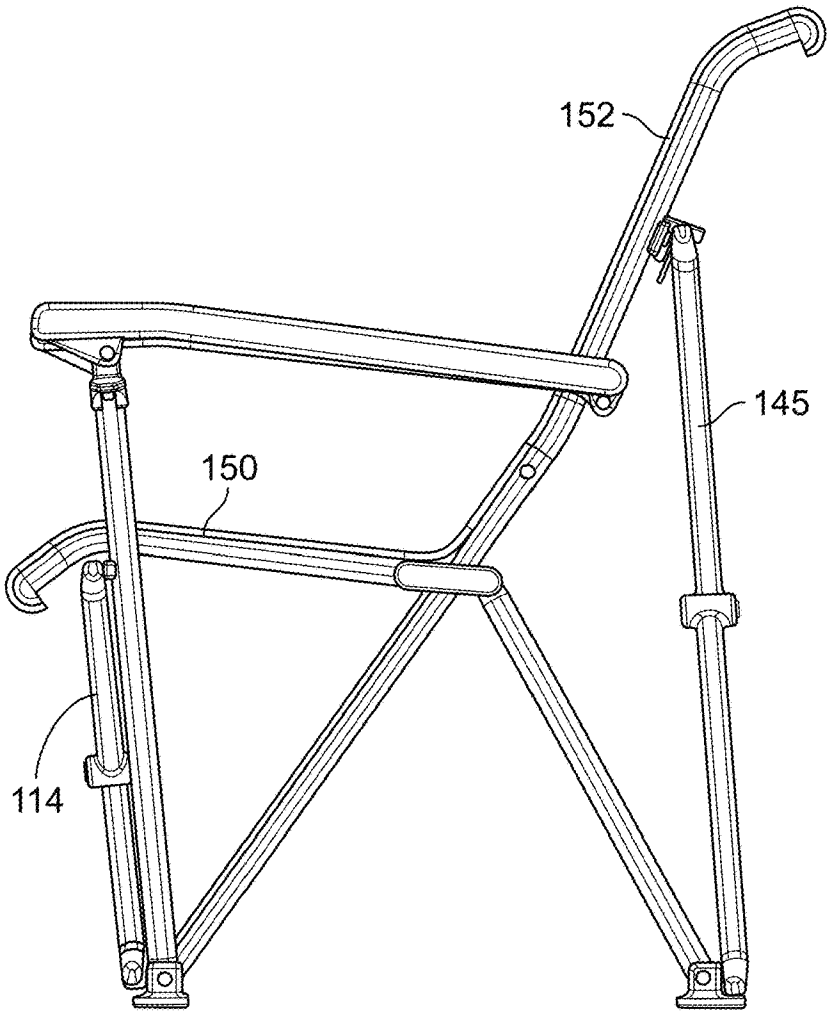
Figure 3:
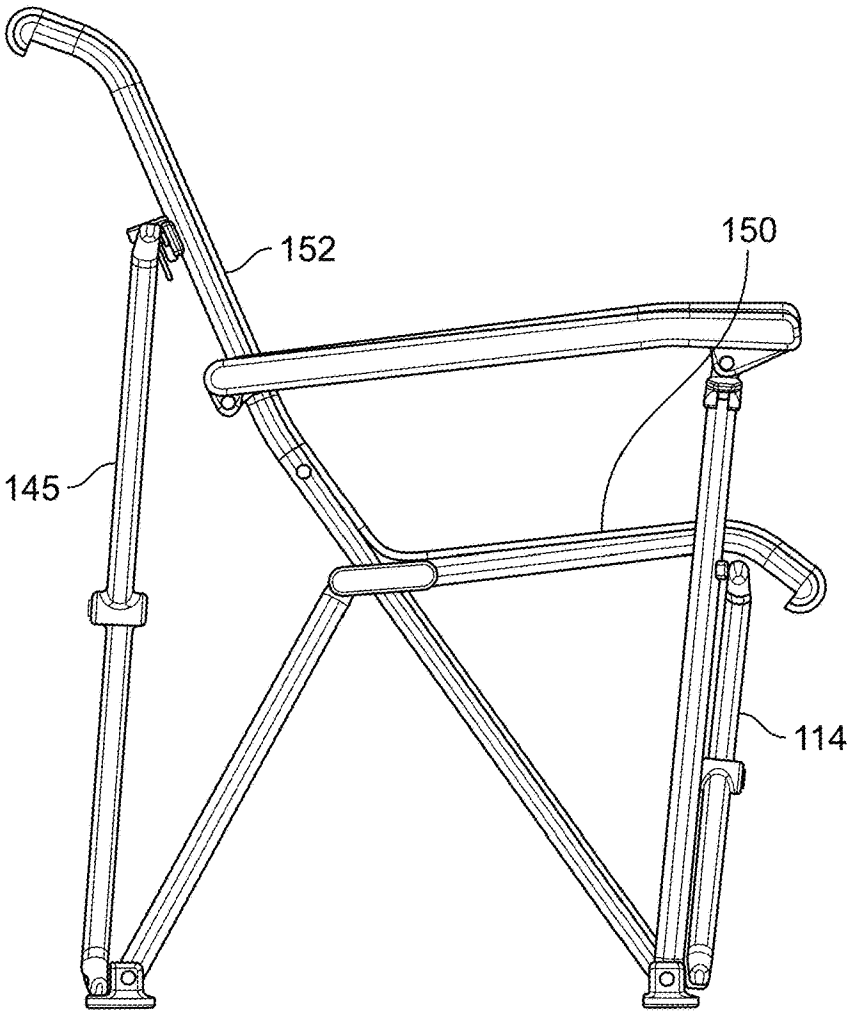
Figure 5:
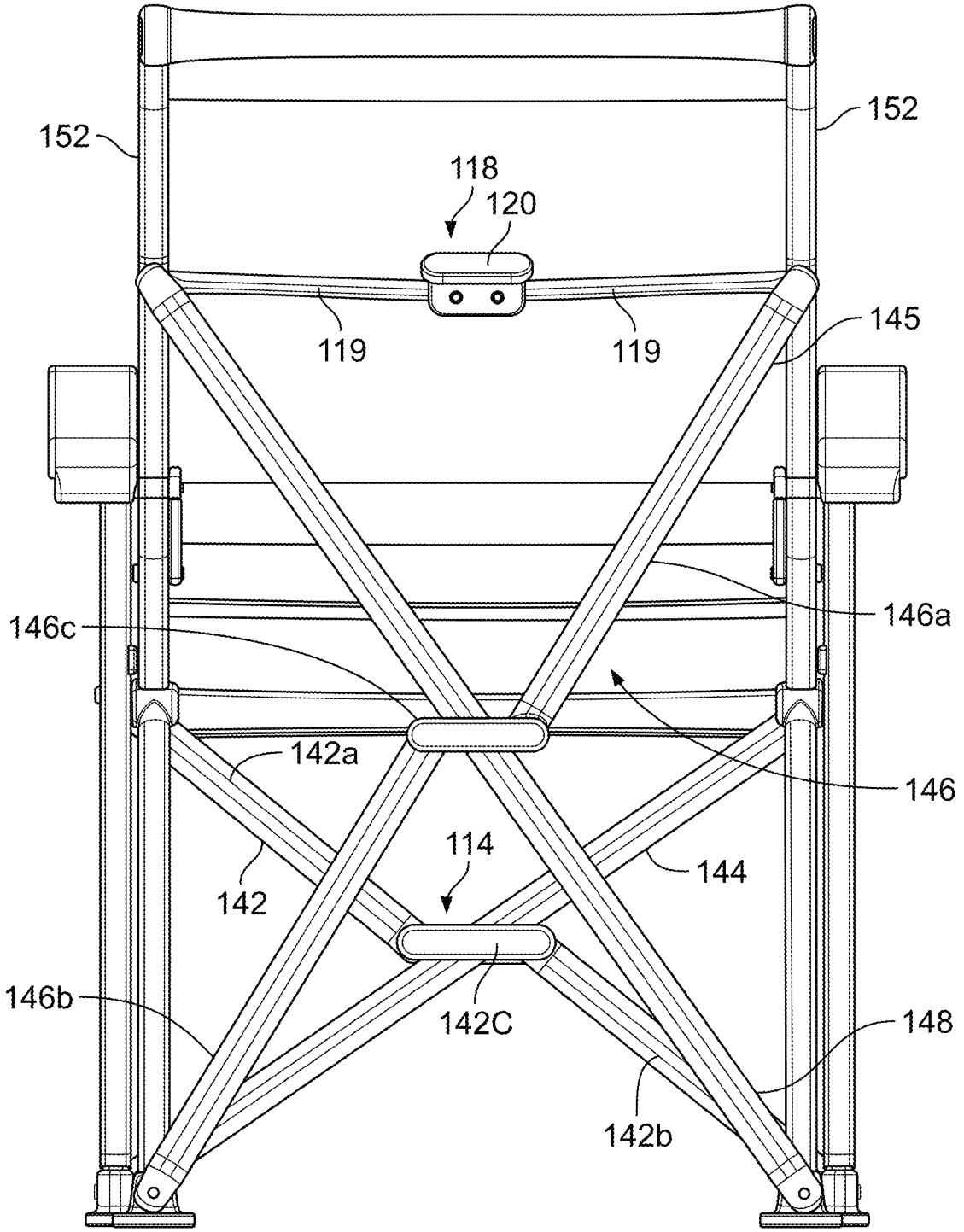
Figure 6:
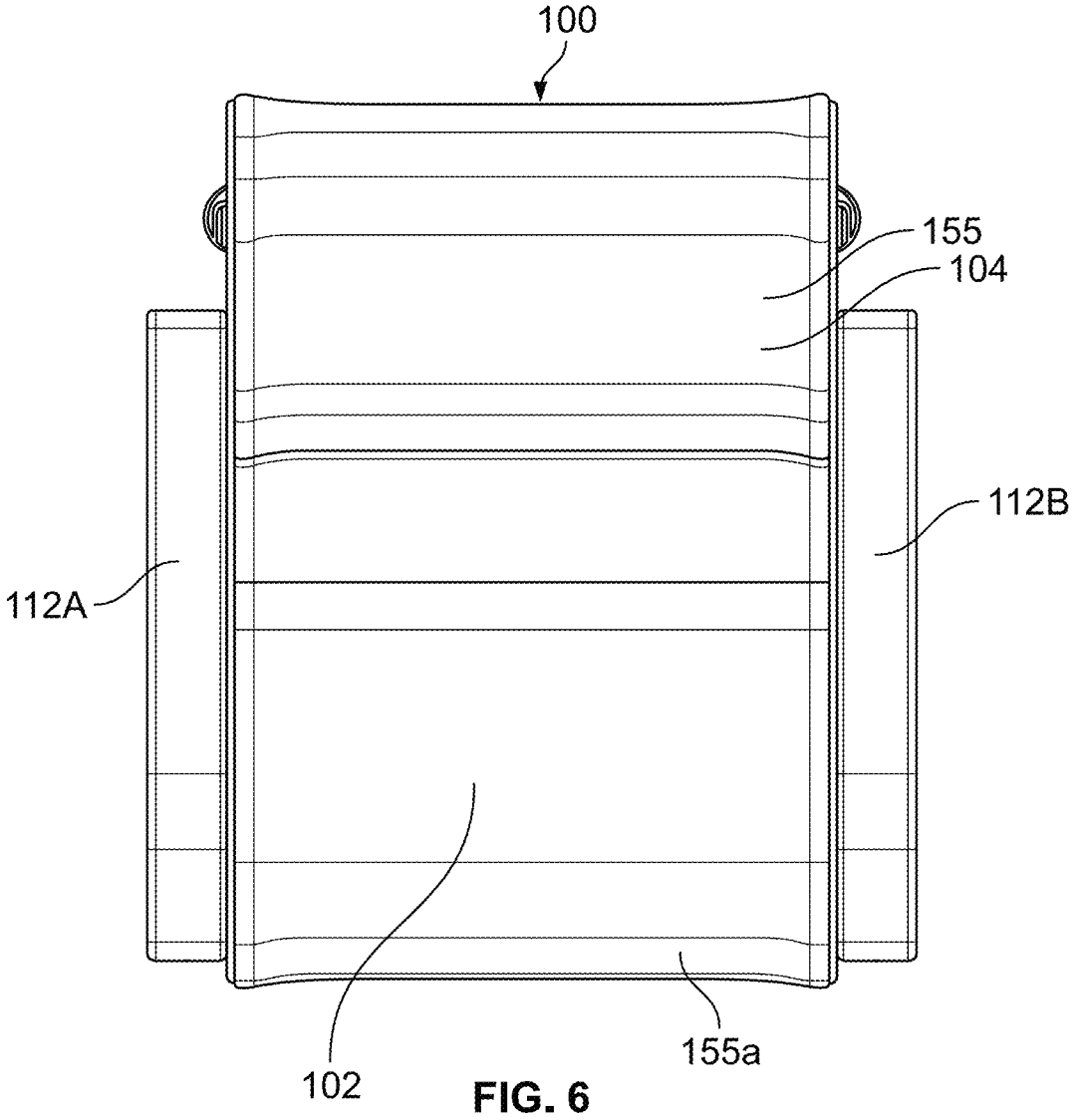

The chair 100, as shown in FIGS. 2 and 5, can include a front X frame 114 formed by the front cross-bars 142, 144. The front cross-bar 142 can be formed by separate front linkages 142*a* and 142*b* connected by front bracket 142*c*. Likewise, the chair 100 can include a rear X frame 145 formed by rear cross-bars 146 and 148. The rear cross-bar 146 can be formed by separate rear linkages 146*a* and 146*b* connected by bracket 146*c*. The chair, as shown in FIG. 1, 100 may also include a pair of armrests 112*a*, 112*b*.

The chair 100 is configured to be folded for easy transport and storage. Cross-sectional views of an example vertical leg 106 is shown in FIGS. 7A and 7B. The vertical leg 106 is made up of a lower inner leg or tube 106*a* and an upper outer leg or tube 106*b*. The inner leg 106*a* telescopes out of the outer leg 106*b* as the chair 100 is folded. In this way, when the inner leg 106*a* moves out of the outer leg 106*b*, the front linkages 142*a*, and 142*b* pivot about the front bracket 142*c* and the ends of the front linkages 142*a* and 142*b* move toward one another. Likewise, when the chair is folded, the rear cross-bar 146 separate rear linkages 146*a* and 146*b* pivot on bracket 146*c* and the ends of the linkages 146*a*, 146*b* move toward one another. This allows the chair to be in a folded or collapsed state where the chair folds into a rectangular or cylindrical profile and can be placed into a bag or case with a corresponding profile. In one example, the length of the folded profile can be defined as the length of the backrest bars 152.

Figure 7:
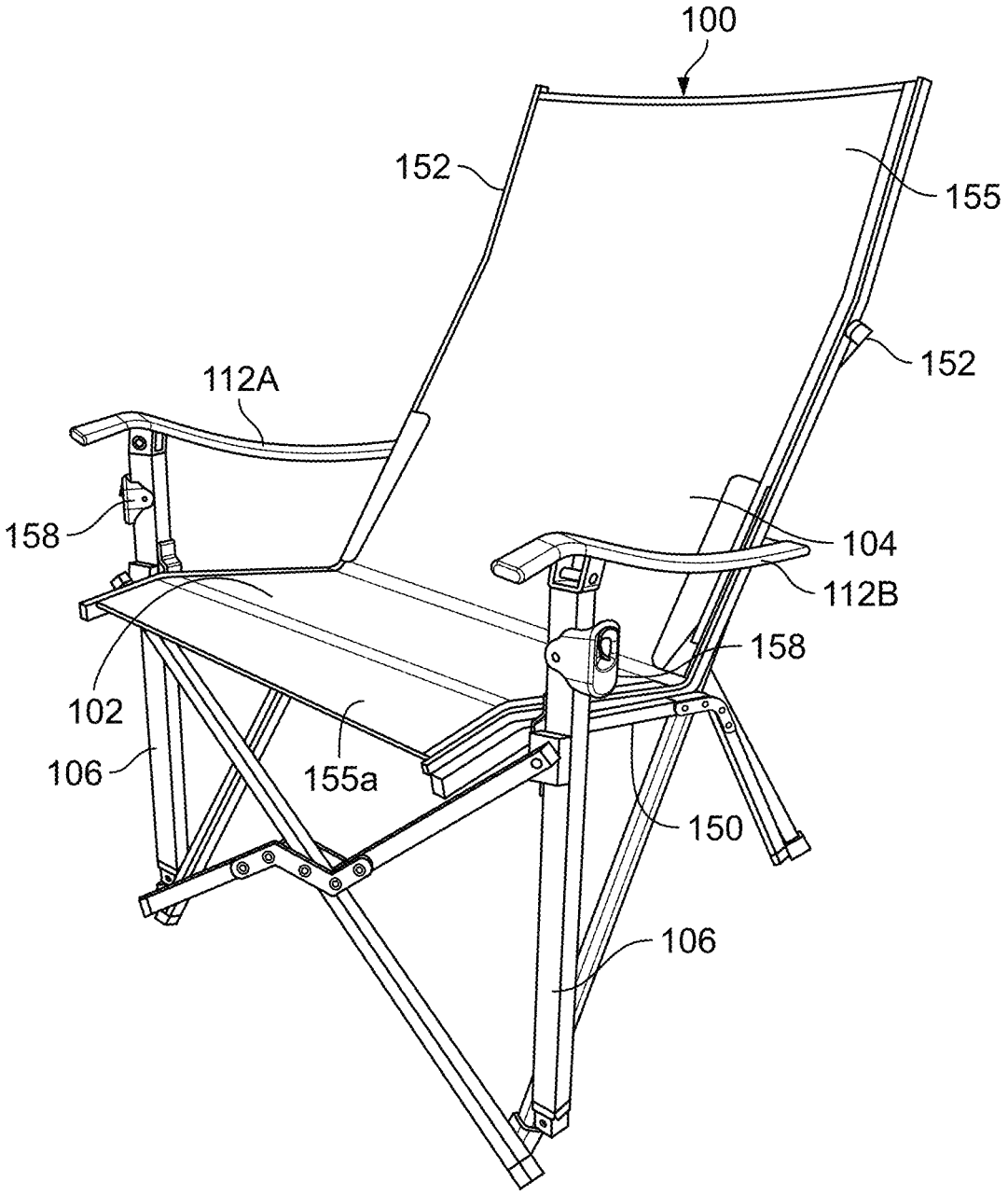
FIG. 7 shows another example folding chair.
Figure 8:
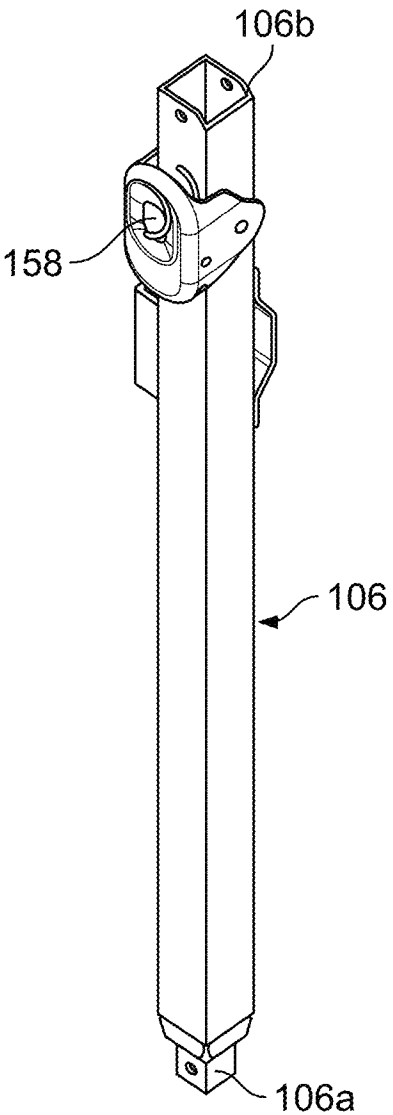
FIGS. 8-12 show various views of the example front leg of FIGS. 7A and 7B.
Figure 7B:
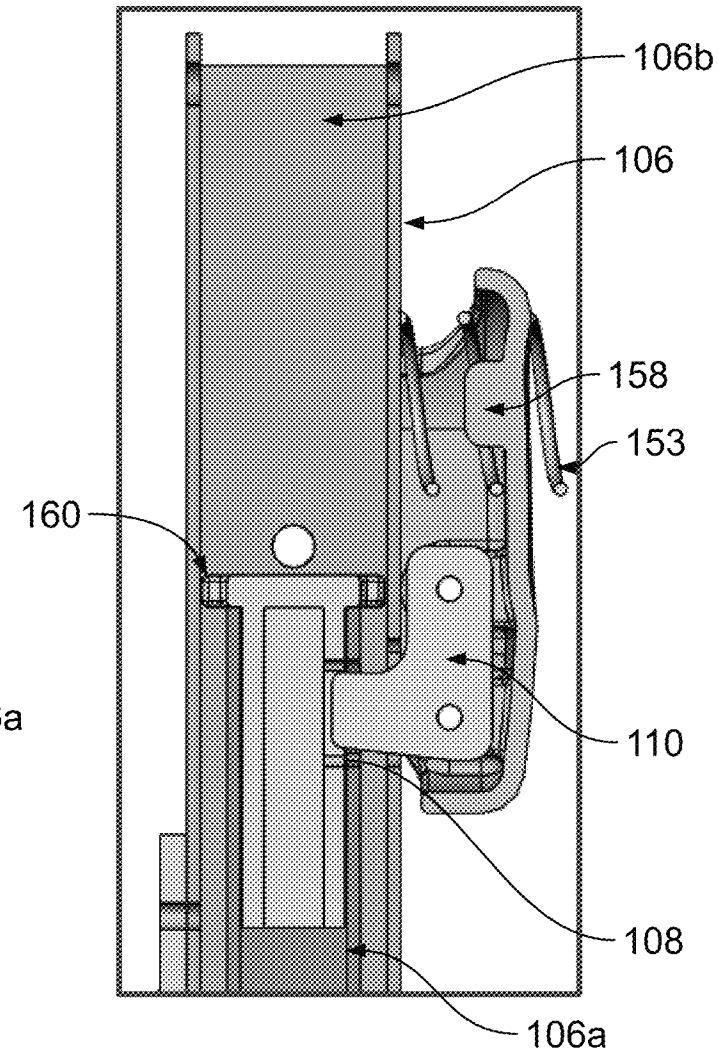
FIGS. 7A and 7B show cross-sectional views of a portion of an example front leg and associated locking mechanism.
Figure 7A:
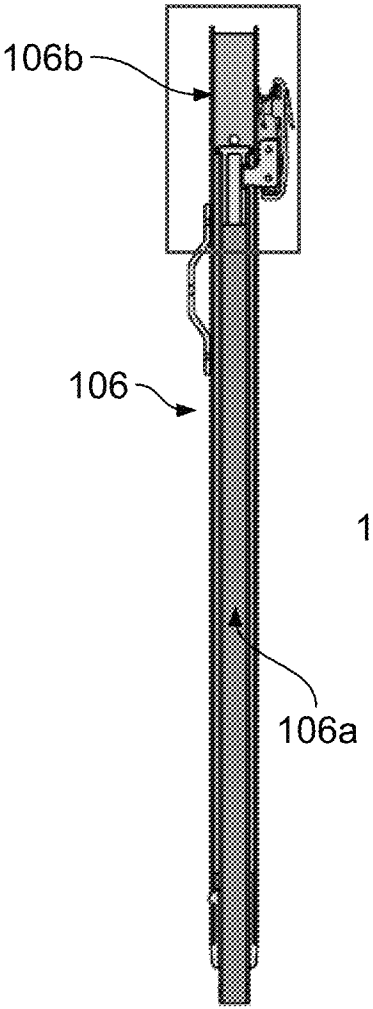

FIGS. 7, 7A, and 7B also show an exemplary latch 110 for locking the outer leg 106*b* to the inner leg 106*a*. The inner leg 106*a* can include a slot 108, and the outer leg 106*b* can include a latch 110 that can be positioned in the slot 108 to lock the outer leg 106*b* to the inner leg 106*a* when the chair is fully opened. When the user presses downwardly on the front of the armrests 112*a*, 112*b*, the latch 110 locks into the slot 108. The latch 110 prevents the inner leg 106*a* from telescoping outward toward the folding position. Because the vertical leg 106 is attached to the top and bottom of the front X frame 114, it expands the X frame 114 to widen the seat pan 102 and tensions the fabric. In this example, both sides of the chair can have the latch 110 to maintain the chair in the unfolded position during use. However, in other examples, only one latch may be provided. The vertical leg can also be provided with a rocker 158 for releasing the latch 110. The latch 110 is solidly attached to and pivots on the rocker 158 so the rocker can move the latch 110 out of the slot 108 of the inner leg 106*a* and unlatches the mechanism allowing the inner leg 106*a* to telescope and for the chair to fold. A spring 153 can also be included to bias the rocker 158 such that it holds the latch 110 in place in the slot 108. To un-latch the vertical leg, the user simply presses the top of the rocker 158. The upper ends of the inner leg 106*a* may also be provided with stops 160 that prevent the inner leg 106*a* from moving out of the outer leg 106*b*. In other examples, the latch 110 for locking the outer leg 106*b* to the inner leg 106*a* may consist in part of a telescoping clamp, a button clip device, a quick release ball lock pin, a locking button, internal push button, a flip lever clamp, or similar device.

In one example, the inner leg 106*a* and the outer leg 106*b* can be formed of aluminum or any other suitable strong lightweight material. The latch 110 can be formed of stainless steel for strength and corrosion resistance or other suitable material with similar characteristics such as a plastic, glass filler nylon, carbon fiber, or other rigid composites or laminates. Likewise, the rocker 158 can, in certain instances, be made out of glass filler nylon, plastic, carbon fiber, or other rigid composites or laminates for strength.

Figures 9, 10, 11, 12:
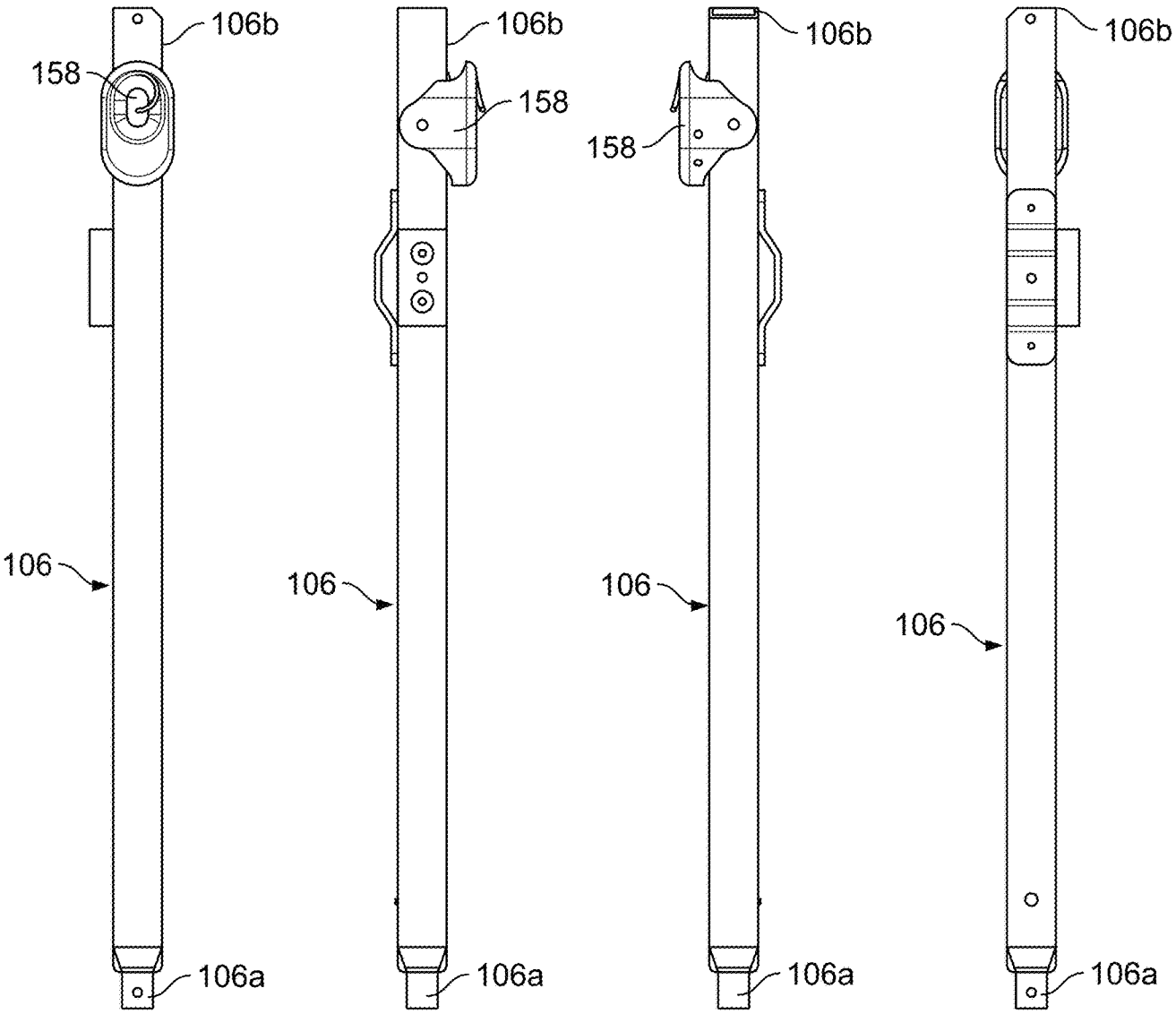

In one example, the backrest 104 can be tensioned by an over-center latch 118 that is made out of four separate components: a center handle 120, two links 119, and an insert 121. The over-center latch 118 can be seen on the chair in FIG. 12A1. A perspective view of the over-center latch 118 is shown in FIG. 12A1, a cross-sectional view is shown in FIG. 12C, and a rear view is shown in FIG. 12D. The over-center latch 118 is activated by the use by pressing down on the center handle 120. The latch 118 is disengaged when the user pulls up on the center handle 120. The latch 118 tensions the fabric by forcing it wider and then the latch 118 goes over center to maintain the width. The downward stop in the latch is accomplished when ends of the links 119 contact the upper portion of the insert 121.

To engage the over-center latch the user simply presses downwardly on the handle 120 such that the links 119 force the rear X frame 146 outward so that the fabric 155 is tensioned in the backrest 104. To release the over-center latch 118, the user simply pulls upwardly on the handle 120 such that the tension by the links 119 on the fabric 155 is released.

Figure 13A:
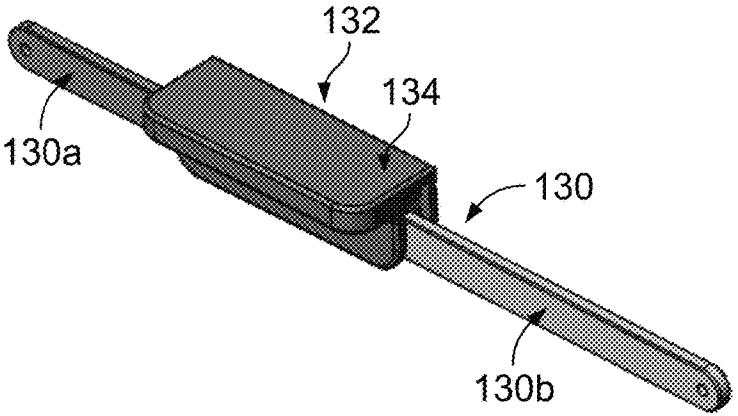
FIGS. 13A-13C show various views of the backrest locking mechanism of FIG. 13.
Figure 13B:
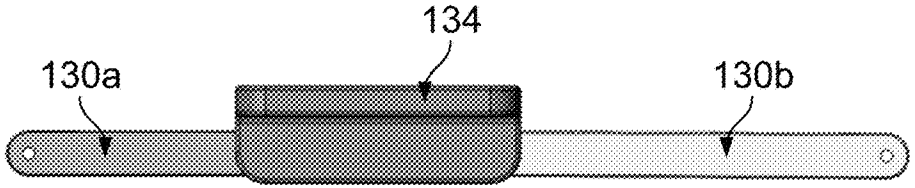
Figure 13C:
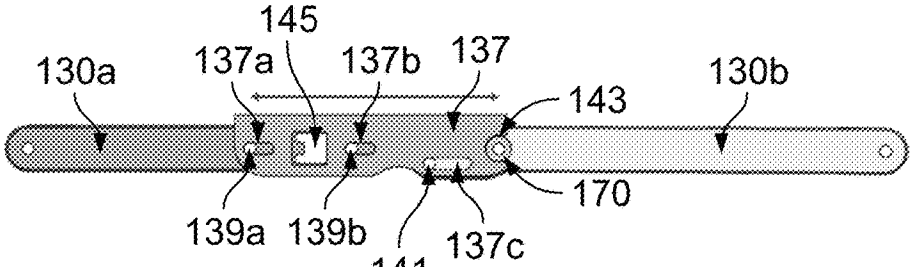
Figure 13:
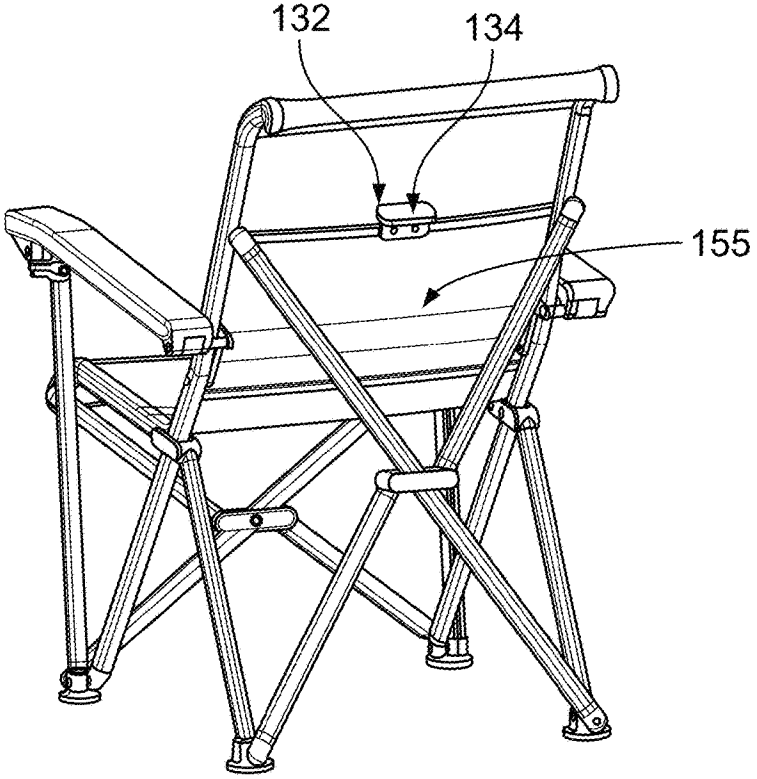
FIG. 13 shows a rear perspective of another example chair with an alternative backrest locking mechanism.

FIGS. 13-13C show another method of tensioning the backrest 104. In this example, a latch 132 is formed of a two bar linkage 130 comprising links 130*a*, 130*b* that latch when the user pushes a handle 134 connecting the two-bar linkage 130 downward and aligns the links 130*a*, 130*b* in a straight line. The handle 134 can include an insert 137. The insert 137 includes slots 137*a*, 137*b* for receiving pins 139*a*, 139*b* on link 130*a* and slot 137*c* for receiving pin 141 located on link 130*b*. The insert 137 can also include a notch 143 that receives a cam or boss 170 located on link 130*b*. A spring not shown can be included in recess 145 that biases the insert 137 against the link 130*a* to lock the two bar linkage 130 and tension the fabric 155.

The user presses down on the handle 134 to engage the latch 132. This causes the links 130*a*, 130*b* to rotate until they are aligned in a straight line, and the notch 143 is locked into place in the cam 170 located on the link 130*b*. To disengage the latch 132, the user slides the handle 134 to the left. The handle 134 is attached directly to the latch 132. As the handle 134 and insert 137 are moved to the left both slide on the link 130*a*, and the handle 134 and insert 137 disengage from the cam or boss that is attached to the link 130*b*. This allows the link 130*b* to rotate relative to the link 130*a* and allows the chair to fold.

Figure 15B:
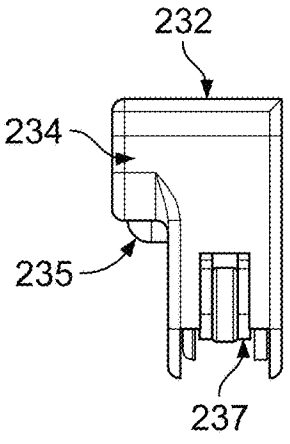
FIG. 15B shows a side view of the example backrest locking mechanism of FIG. 15A.
Figure 15A:
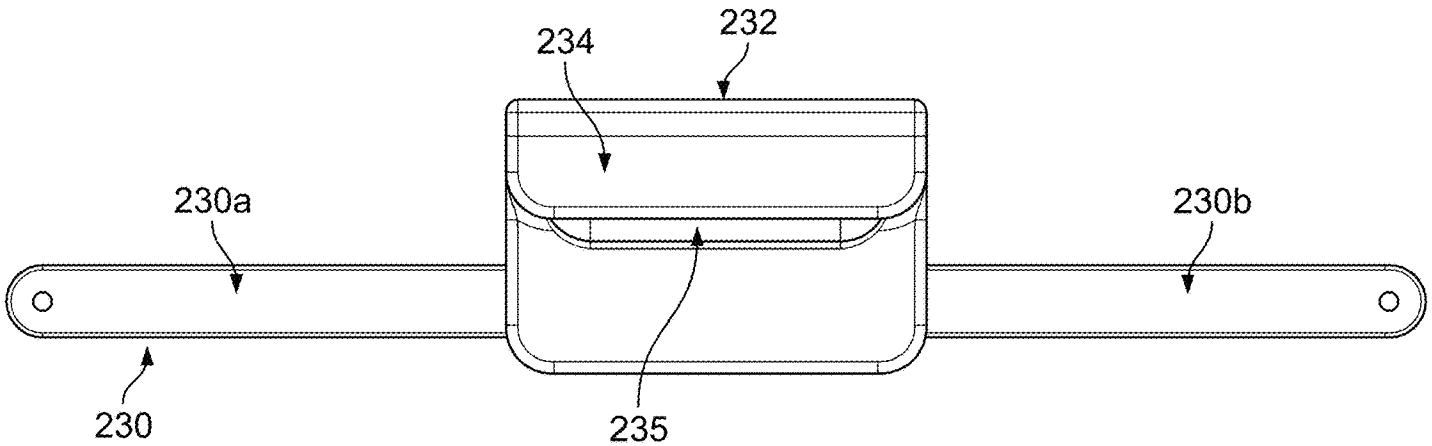
FIG. 15A shows a rear view of another example backrest locking mechanism.

FIGS. 15A-18B show another method of tensioning the backrest 104 in which like reference numerals refer to the same or similar elements having the same or similar functionality in all of the various views in which that reference number appears. In this example, a latch 232 is formed of a two bar linkage 230 comprising links 230*a*, 230*b* that latch when the user pushes a handle 234 connecting the two-bar linkage 230 downward and aligns the links 230*a*, 230*b* in a straight line as shown in FIG. 15A. The handle 234 may include a latch release mechanism 235 that is configured to release the latch from the tensioned position.

Figure 16C:
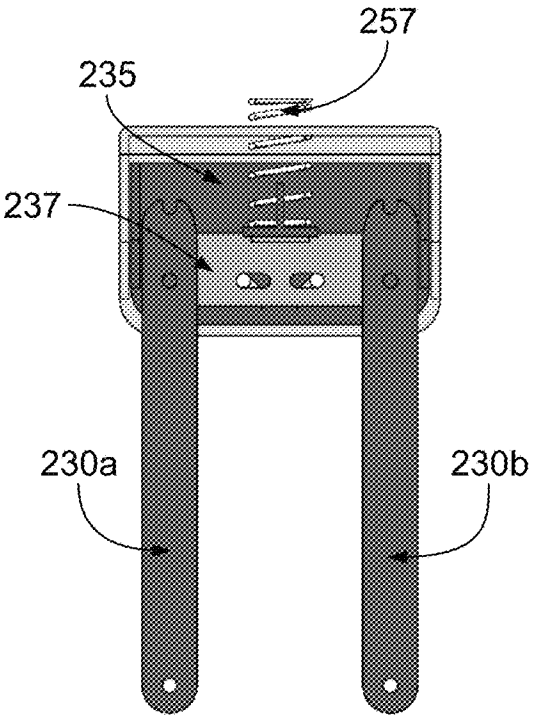
FIG. 16C shows a cross-sectional view of the example backrest locking mechanism of 15A in the folded-up position.
Figure 16A:
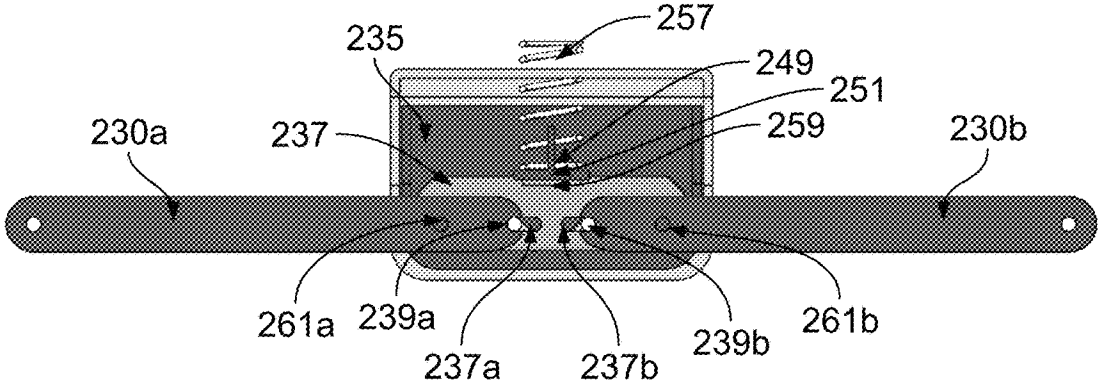
FIG. 16A shows a cross-sectional view of the example backrest locking mechanism of 15A in the tensioned position.
Figure 16B:
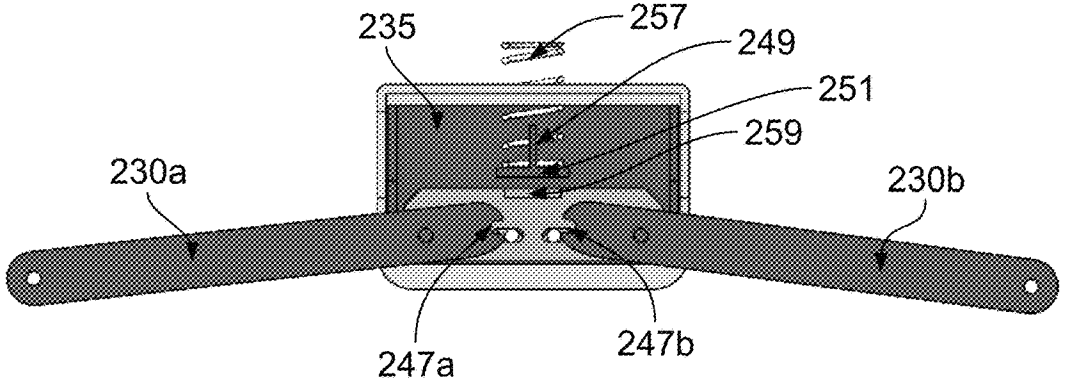
FIG. 16B shows a cross-sectional view of the example backrest locking mechanism of 15A in the released position.

The links 230*a*, 230*b* are configured to hold the backrest of the chair in the unfolded position or sitting position. The links 230*a*, 230*b* are configured to rotate on the backrest frame. As shown in FIGS. 16A-16C, the links 230*a*, 230*b* are also configured to rotate about pivots 261*a*, 261*b* on the insert 237. The links 230*a*, 230*b* can also include a notches 247*a*, 247*b* for receiving the pins 237*a*, 237*b* of the insert. In one example, the receiving notches 247*a*, 247*b* can be located at proximal ends of the links 230*a*, 230*b*.

Figure 15C:
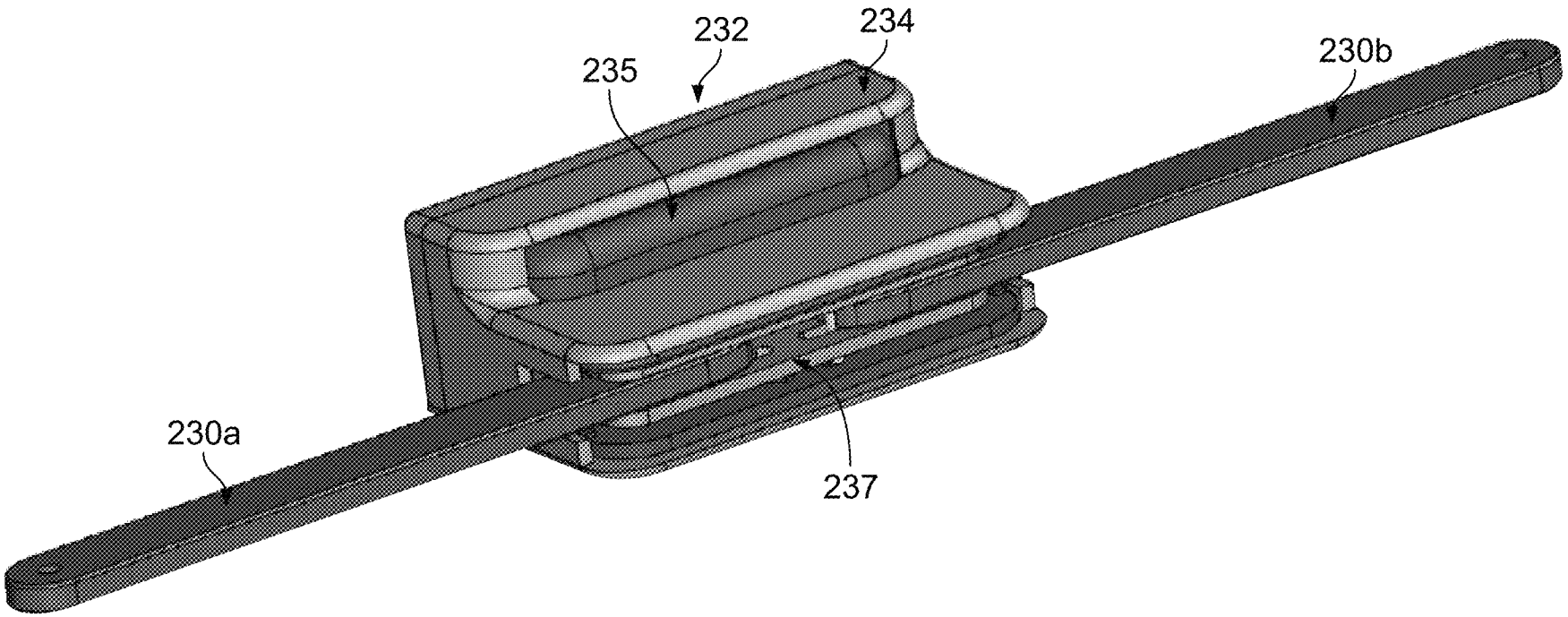
FIG. 15C shows a bottom perspective view of the example backrest locking mechanism of FIG. 15A.

Also shown in FIGS. 16A-18B, the handle 234 can include an inner bracket or insert 237. The insert 237 includes slots 237*a*, 237*b* for receiving pins 239*a*, 239*b*. The slots 237*a*, 237*b* can be located inwardly on the insert. The insert 237 can also include a pair of pivots 261*a*, 261*b* located on the insert outwardly from the slots 237*a*, 237*b* for receiving the links 230*a*, 230*b*. The insert 237 can also include a projection 259 for abutting the latch mechanism 235. In one example, as shown in FIG. 15C, the insert 237 can be formed of a pair of plates.

Figure 17B:
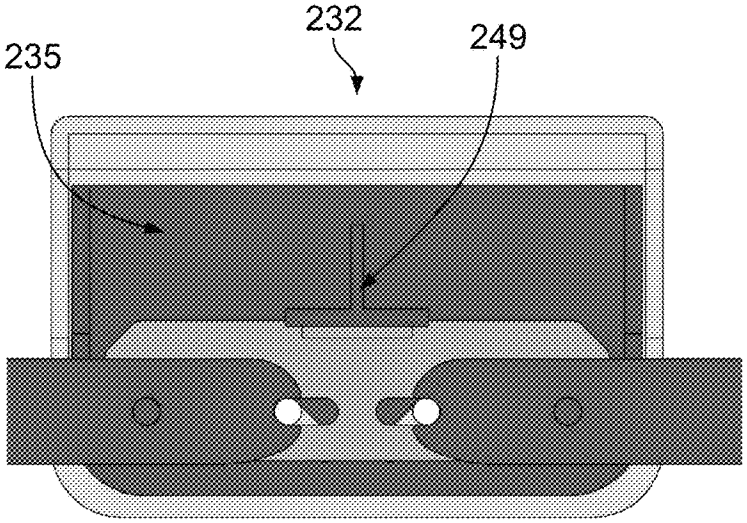
FIG. 17B shows a rear cross-sectional view of the example backrest locking mechanism of FIG. 15A in a tensioned configuration.
Figure 17A:
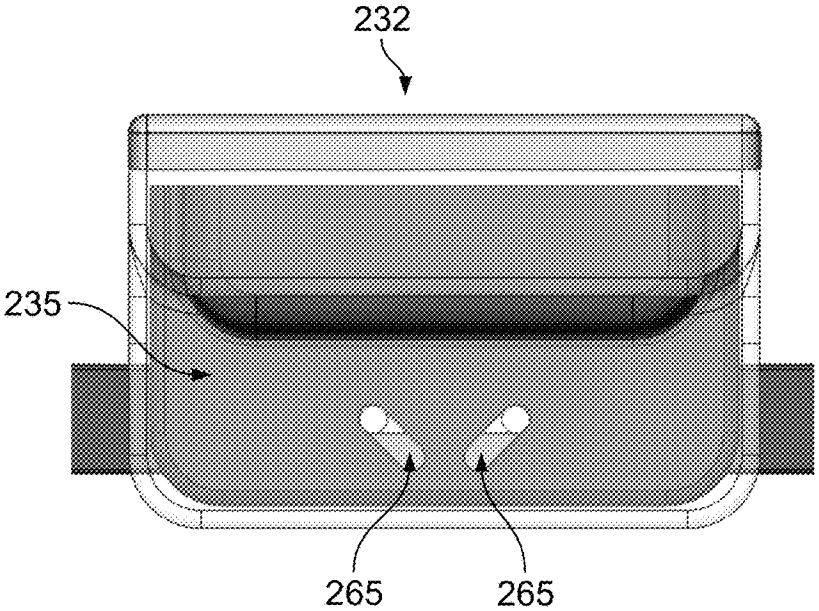
FIG. 17A shows a front cross-sectional view of the example backrest locking mechanism of FIG. 15A in a tensioned configuration.
Figure 18B:
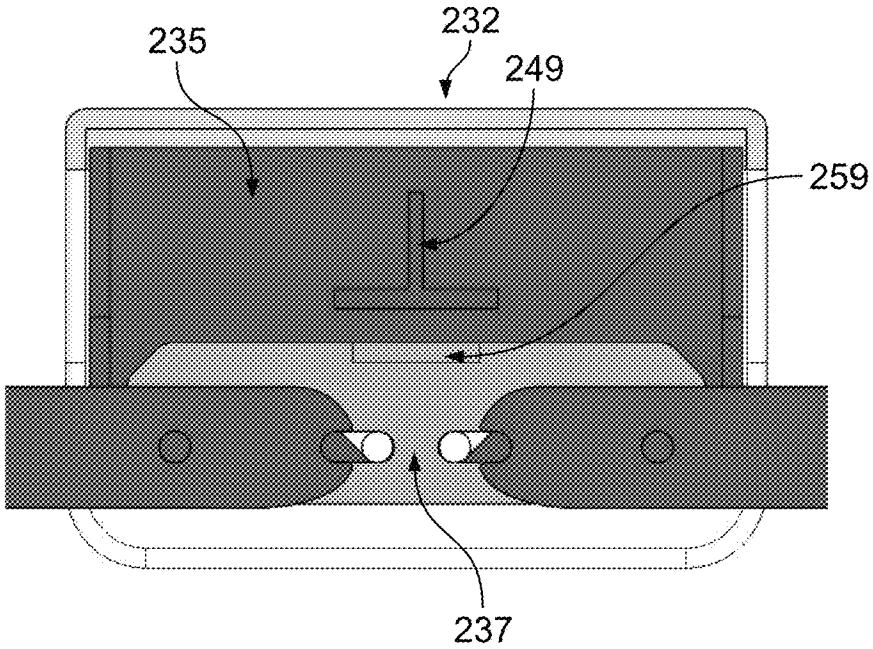
FIG. 18B shows a rear cross-sectional view of the example backrest locking mechanism of FIG. 15A in a released configuration.
Figure 18A:
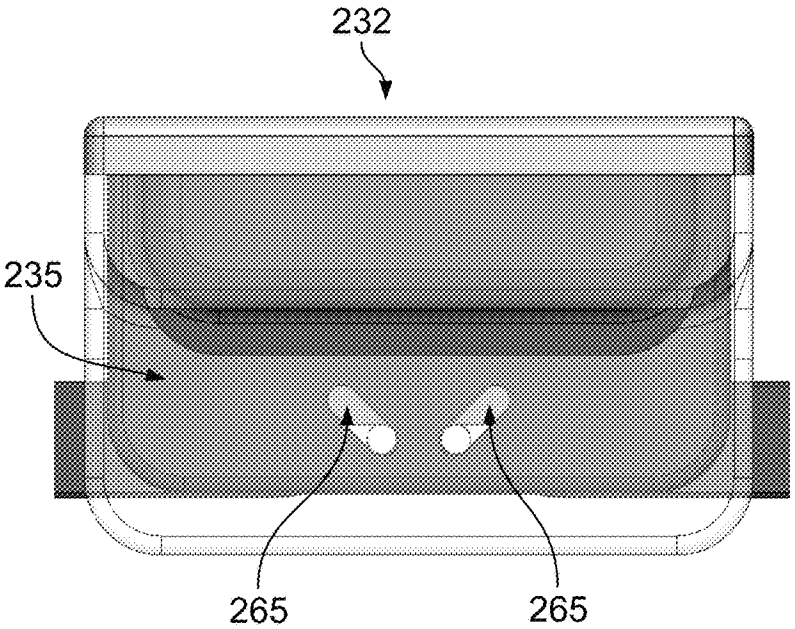
FIG. 18A shows a front cross-sectional view of the example backrest locking mechanism of FIG. 15A in a released configuration.

Referring again to FIGS. 16A-16C, the latch release mechanism 235 can include a spring support seat 249 for supporting spring 257. The spring support seat 249 includes a lower flange 251. The upper portion of the flange supports the spring 257 and the lower portion of the flange is configured to abut against the projection 259 on the insert 237. The latch release mechanism 235 may also include a pair of angled slots 265, which are shown in FIGS. 17A and 18A. In one example, the angled slots 265 are positioned at approximately 45 degrees from a plane defined by a lower portion of the tensioner and can be symmetrically placed on the release mechanism.

The operation of the latch 232 will now be described in relation to FIGS. 16A-18B. FIG. 16A depicts the latch 232 in the tensioned position. In the tensioned position, the latch 232 holds the backrest of the chair in the unfolded or sitting position. To release the latch 232, the user simply pushes up on the latch release mechanism 235 against spring 257 causing the angled slots 235 to pull the pins 239*a*, 239*b* away from notches 247*a*, 247*b* of links 230*a*, 230*b* as shown in FIG. 16B where the latch 232 is in the released position. As the backrest is folded the links 230*a*, 230*b* continue to rotate about pivots 261*a*, 261*b* into the position shown in FIG. 16C. The spring continuously biases the latch release mechanism 235 against the insert 237 so that once the chair is placed back into the unfolded position, the notches 247*a*, 247*b* are allowed to engage the pins 239*a*, 239*b* again to hold the links 230*a*, 230*b* in the tensioned position.

Figure 19A:
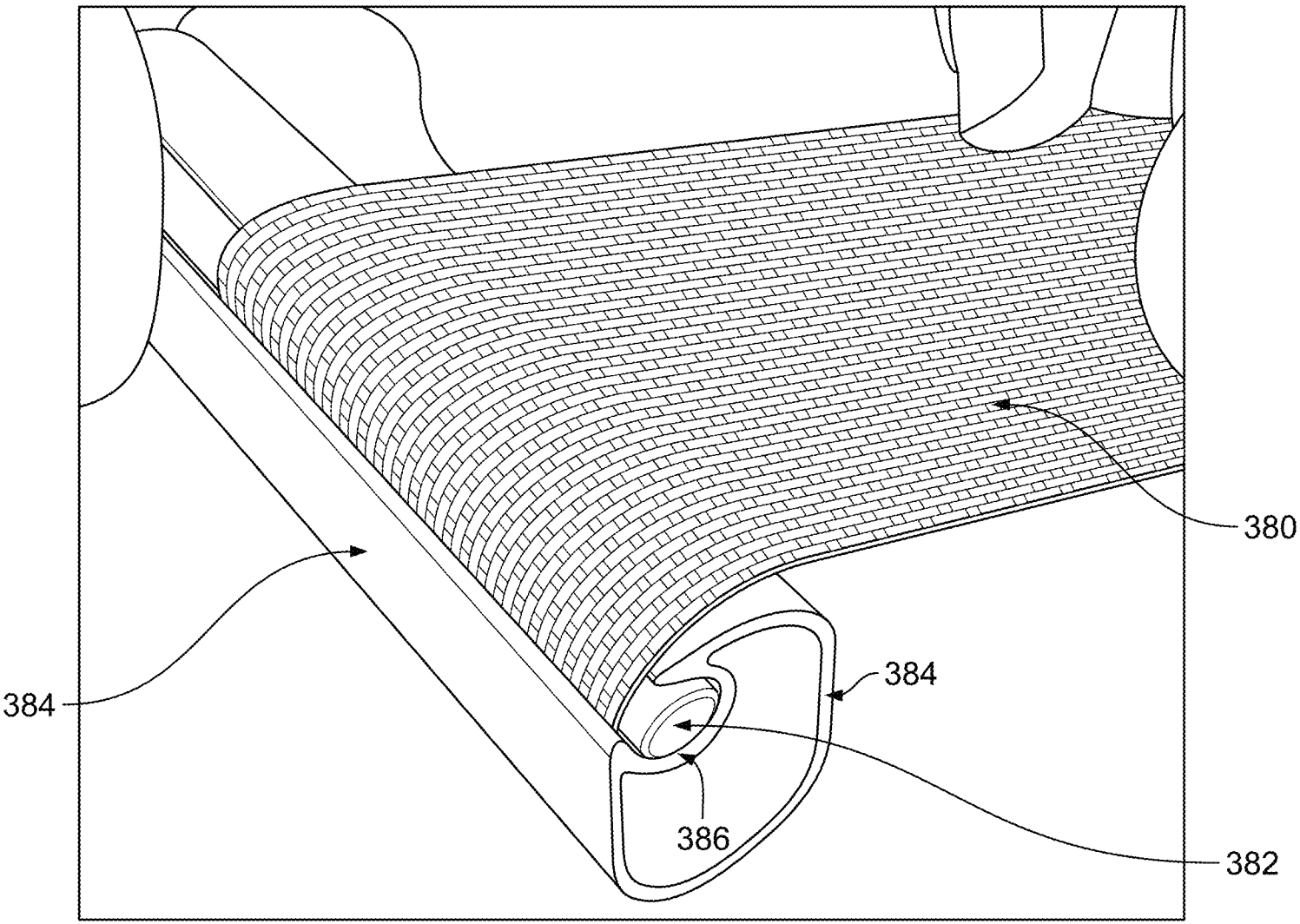
FIGS. 19A and 19B illustrate an attachment method for securing suspension fabric to a frame.
Figure 19B:
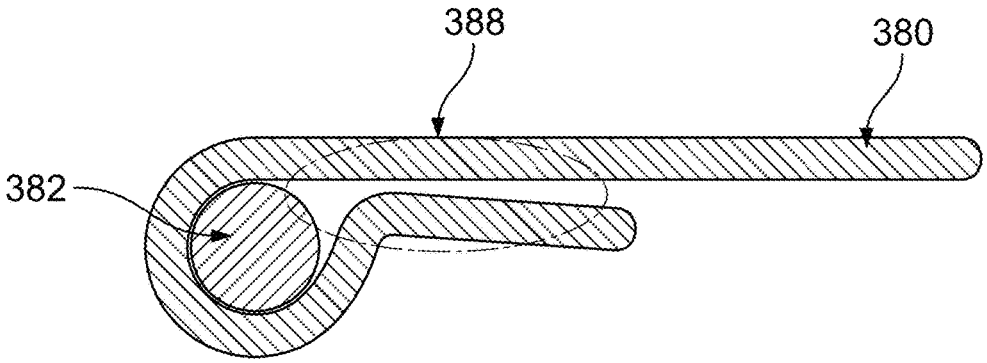

FIGS. 19A and 19B depict a technique for securing a suspension fabric 380 to a frame or extrusion 384. In this example, the fabric 380 can be wrapped around a core 382 and then folded back on itself to create an overlap 388. The overlap 388 of the fabric can them be ultra-sonically welded together. The overlap 388 may also include an adhesive to aid in holding the fabric together. In still other examples, the overlap 388 may be sewn together. The core 382 can then be fed into a hollow section or tube that makes up the frame 384. In certain examples, the frame could be for a number of consumer products such as a chair, table, shelter, tent or stool.

Figure 20:
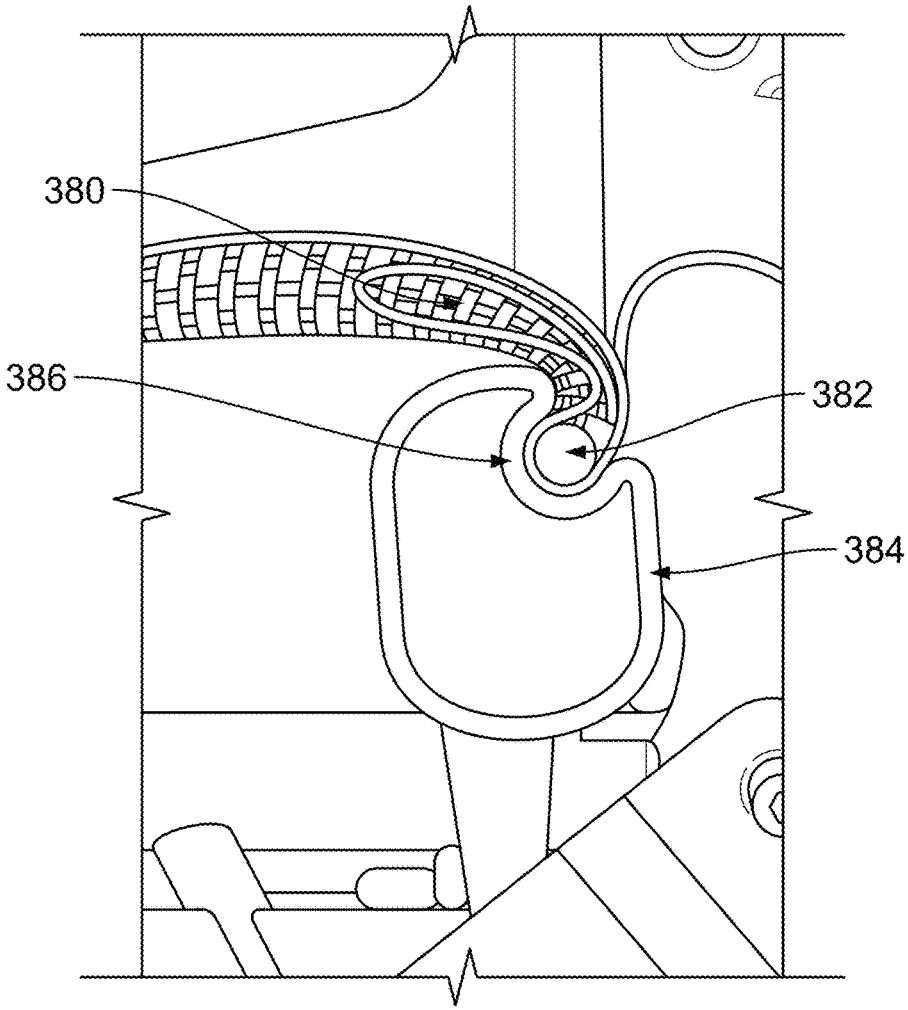
FIG. 20 is an expanded top view illustrating the attachment method for securing suspension fabric to a frame as shown in FIGS. 19A and 19B.
Figure 21B:
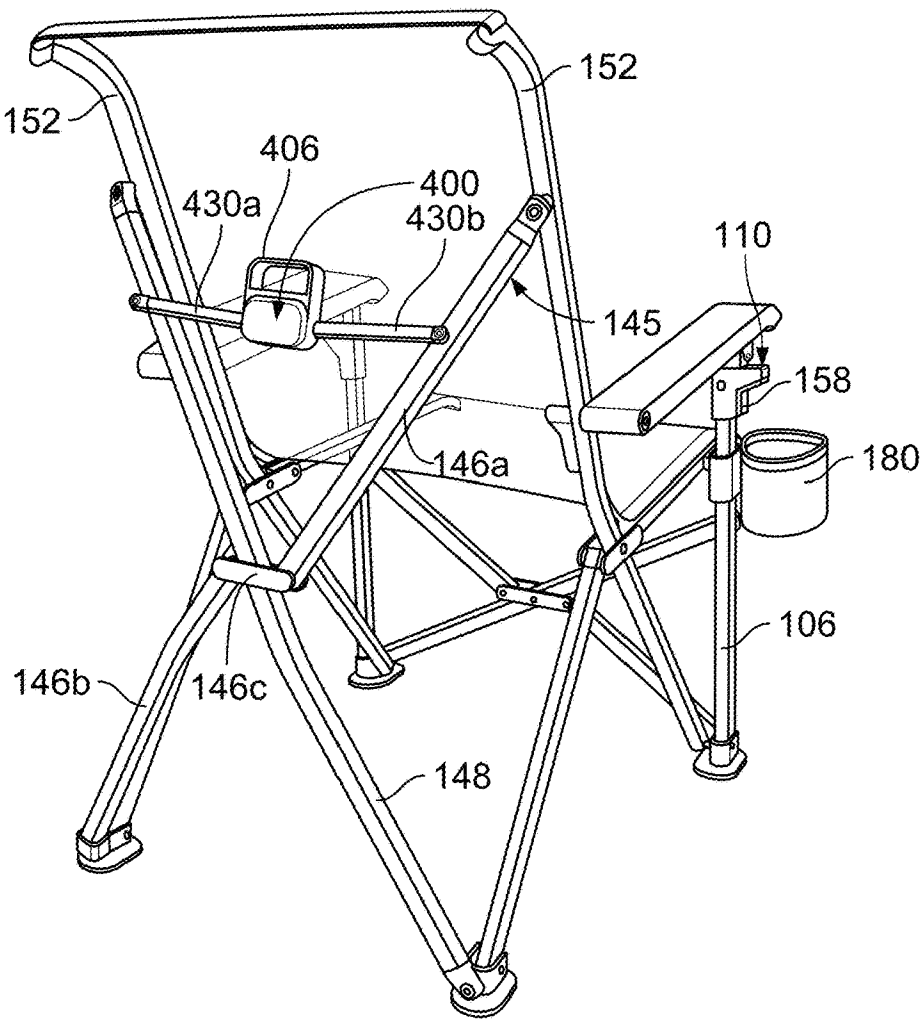
FIGS. 21A and 21B show another example folding chair formed with an integral cup holder and an example of a backrest rear tensioning mechanism.
Figure 21A:
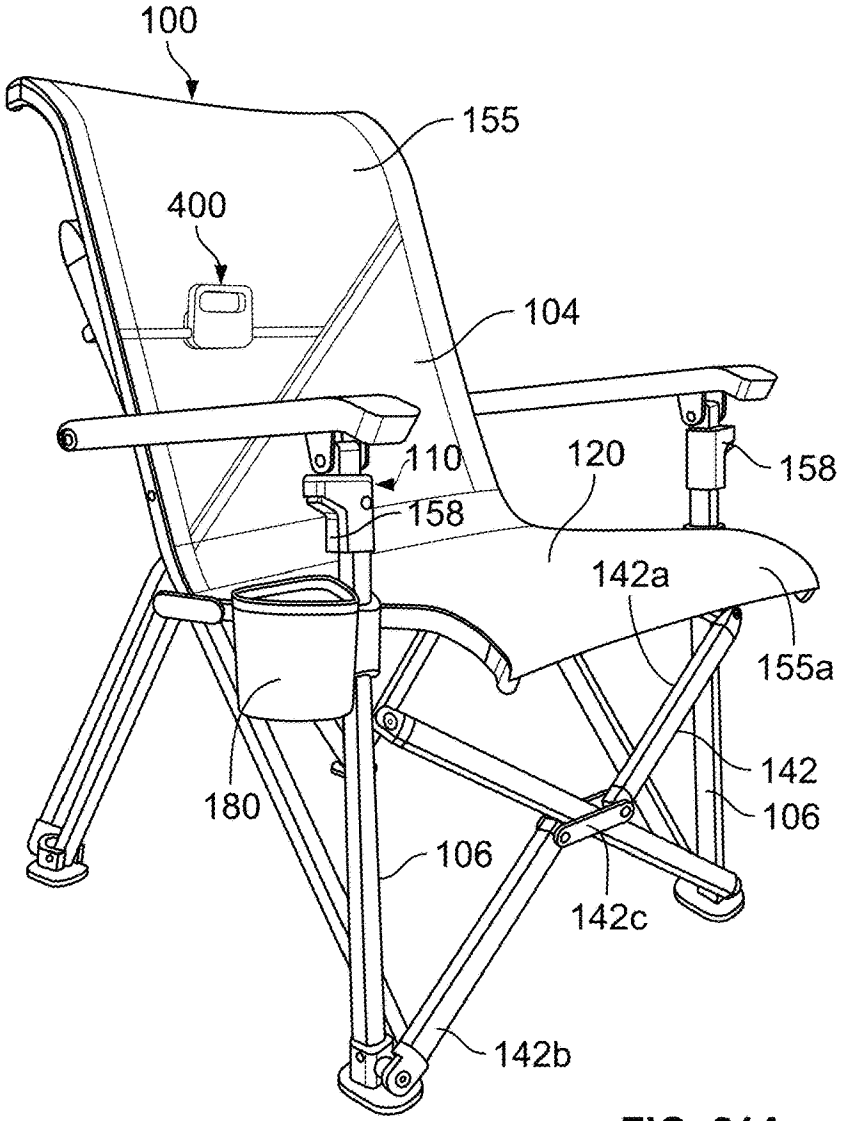

FIG. 20 depicts an alternative view of FIG. 19A and depicts the technique for securing the suspension fabric 380 to a frame or extrusion 384. The core 382 is fed into an asymmetrical notch 386 formed in the hollow section or tube that makes up the frame or extrusion 384. When the fabric 380 is wrapped around the core 382 and placed into the notch 386 asymmetrically located formed in the hollow section of the tube, frame, or extrusion 384, the configuration forms a friction fit. In other embodiments, the fabric 380, core 382, and the asymmetrical notch 386 may include an adhesive to assist in securing the suspension fabric 380 to the frame or extrusion 384. The asymmetrical notch 386 is uniquely positioned at a point on the frame or extrusion 384 that is not symmetrical with any point on the extrusion (i.e., top, side, middle, etc.). The notch 386 may be asymmetrically located or positioned "off-center" on the frame or extrusion 384. The notch 386 may be asymmetrically positioned in the hollow frame 384 at or about a 10 or 11 o'clock position or the 1 or 2 o'clock position if the top of the hollow frame 384 is the 12 o'clock position. In still other examples, the notch 386 may be positioned in a symmetrical position in the frame 384. For example, the notch 386 may be positioned at or about the 3, 6, 9, or 12 o'clock position. The notch 386 may be substantially semi-circular shaped, substantially circular shaped, or substantially oval shaped. The core 382 may be a flexible plastic, a rigid plastic, fabric, aluminum, wood, steel, composite, alloy, or other metal. In other examples, the core may be rigid, semi-rigid, or non-rigid. In some examples, the core may be substantially shaped like a rod or cylinder. In still other examples, the core can be a rod or cord, which can be formed of plastic, nylon, foam, braided fibers, fabric, aluminum, wood, steel, composite, alloy, metal, etc.

Securing the suspension fabric 380 to the frame 384 via the asymmetrical notch 386 may help to hide the connection between the suspension frame fabric and the frame to provide a cleaner look to the chair. Also, securing the suspension fabric 380 to the outer portion of the frame 384 via the positioning of the asymmetrical notch 386 creates a mechanical advantage due in part to the additional surface area that the suspension fabric 380 contacts of the frame 384. The resulting mechanical advantage provides additional strength to better secure the suspension fabric 380 to frame or extrusion 384. Also, the use of an asymmetrical notch may extend the life of the chair by reducing the amount of stress on the fabric. In particular, the asymmetrical notch helps to move the connection of the fabric to the frame away from direct loading. However, other methods for securing the fabric to the frame are also contemplated, such as overmolding the fabric to the frame as discussed in Ser. No. 15/602,841 filed on May 23, 2017, which is fully incorporated herein by reference.

With both of a tensioning mechanism for the seat and a tensioning mechanism for the backrest, the chair holds it form and does not fold up during the use of the chair, until desired by the user.

FIGS. 21-29 depict a folding chair with an alternative configuration for a tensioning mechanism that may include a rear tensioner for maintaining the backrest in the unfolded position or tensioned position. In one example, the backrest 104 can be tensioned by a rear tensioner 400, as shown in FIG. 22A. As shown in FIG. 22B, rear tensioner 400 may include at least two rear tensioner arms 430.

Figure 22B:
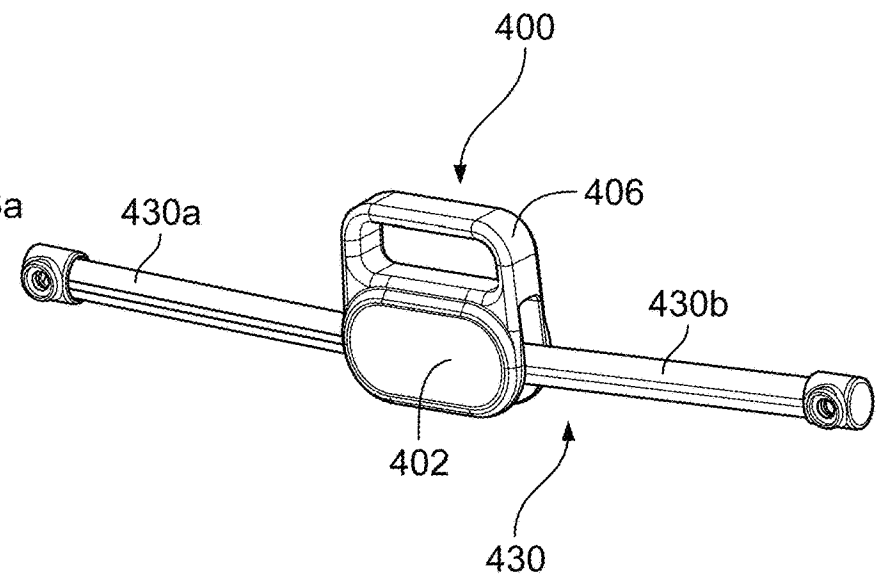
FIG. 22B illustrates shows a rear view of the example backrest rear tensioning mechanism from FIG. 22A.
Figure 22A:
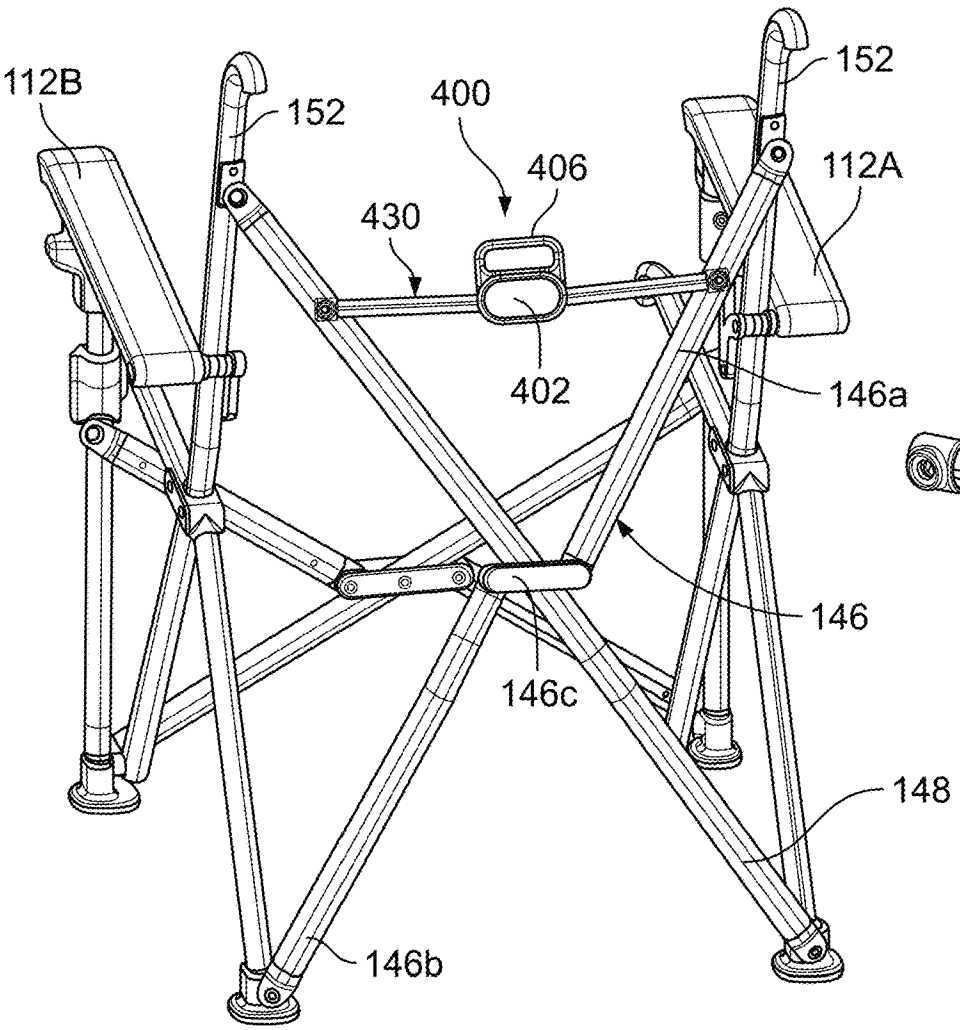
FIG. 22A illustrates another example folding chair frame, with the suspension fabric removed, with a backrest rear tensioning mechanism.
Figure 23:
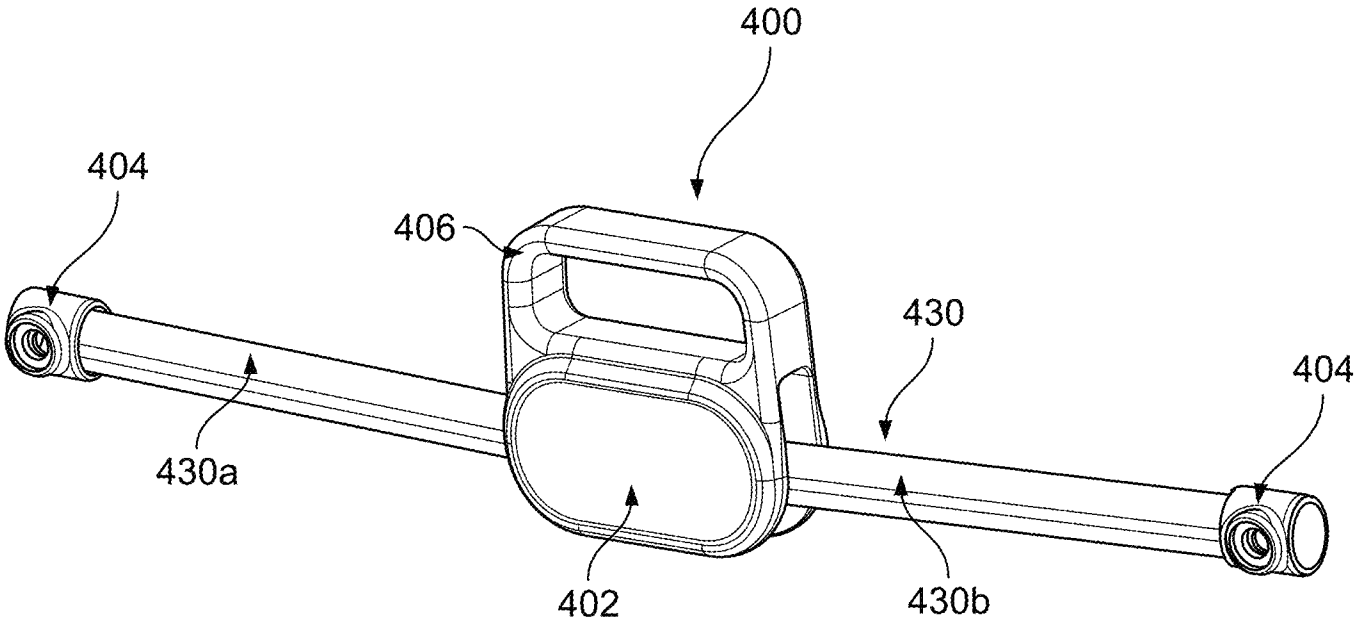
FIG. 23 illustrates an expanded assembly view of the example rear tensioning mechanism from FIG. 22A.

FIG. 23 illustrates an expanded assembly view of the example rear tensioning mechanism from FIG. 22A. In one example, as shown in FIG. 23, the rear tensioner 400 may include a handle and housing 422 below the grasping portion of the handle 406, rear tensioner arm 430*a*, rear tensioner arm 430*b*, and rear tensioner cap 404. Rear tensioner caps 404 may be connected to rear cross-bars 146*a* and 148. The rear tensioner caps 404 are configured to pivot in a manner that allows the rear tension to move from an unfolded position to a tensioned position. In other examples, the rear tensioner 400 includes rear tensioner cover 402. In one example, the rear tensioner arm 430*a* and 430*b* can be formed of aluminum or any other suitable strong lightweight material. The rear tensioner 400 and handle 406 and housing 422 can, in certain instances, be made out of glass filler nylon for strength, plastic, or other composite. As shown in FIG. 24A, access to the pivot points 408 may be provided when the rear tensioner cover 402 is removed. The pivot points 408 are seated in an oval or rectangular shaped reservoir 412. The rear tensioner cover 402 is shaped in a similar manner as the reservoir 412 (i.e., oval or rectangular shaped). The pivot points 408 are configured to hold pins 410 that run through the rear tensioner arms 430*a* and 430*b*, securing the arms to the rear tensioner 400. Rear tensioner cover 402 includes a plurality of flex fingers and easily snaps into the rear tensioner 400 to cover the reservoir 412.

Figure 24B:
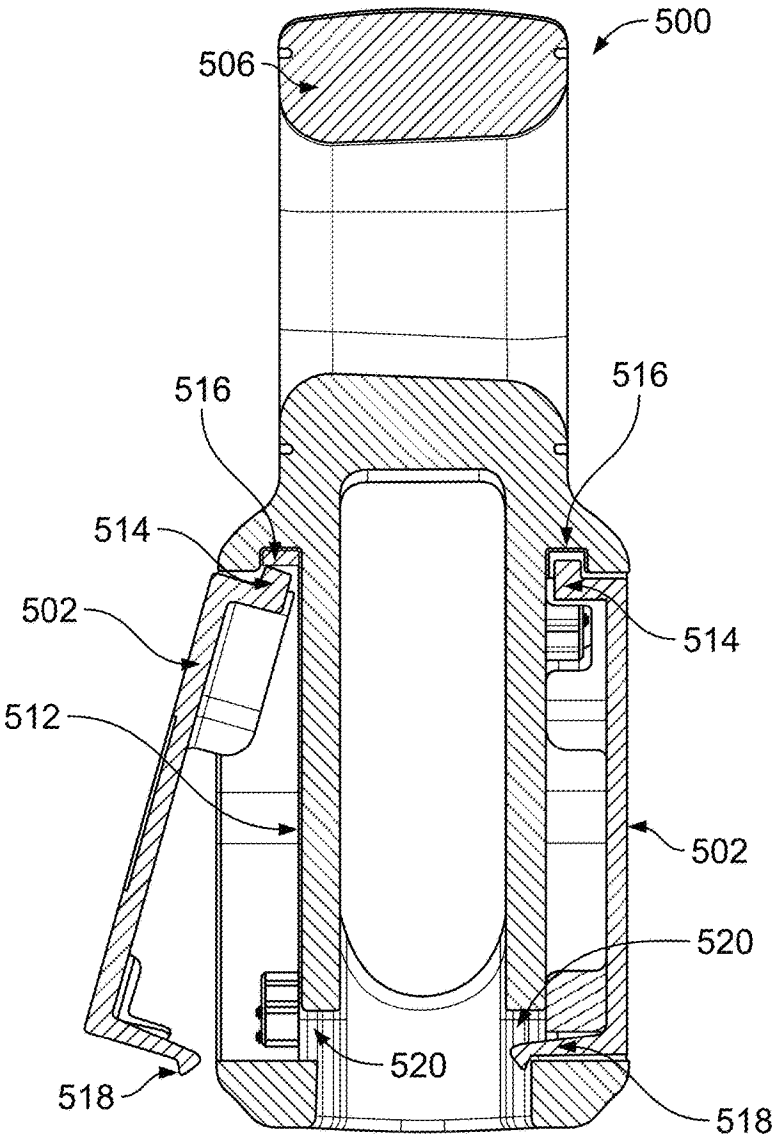
FIGS. 24B-24D illustrates another example backrest tensioning mechanism rear tensioner and rear tensioner cover as described herein.
Figure 24B:
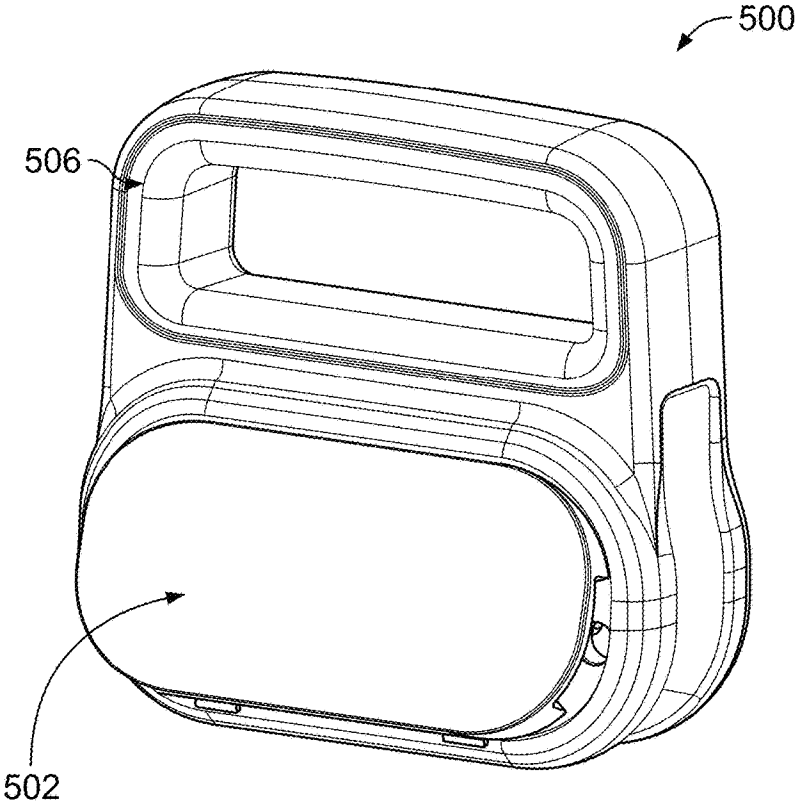
Figure 24C:
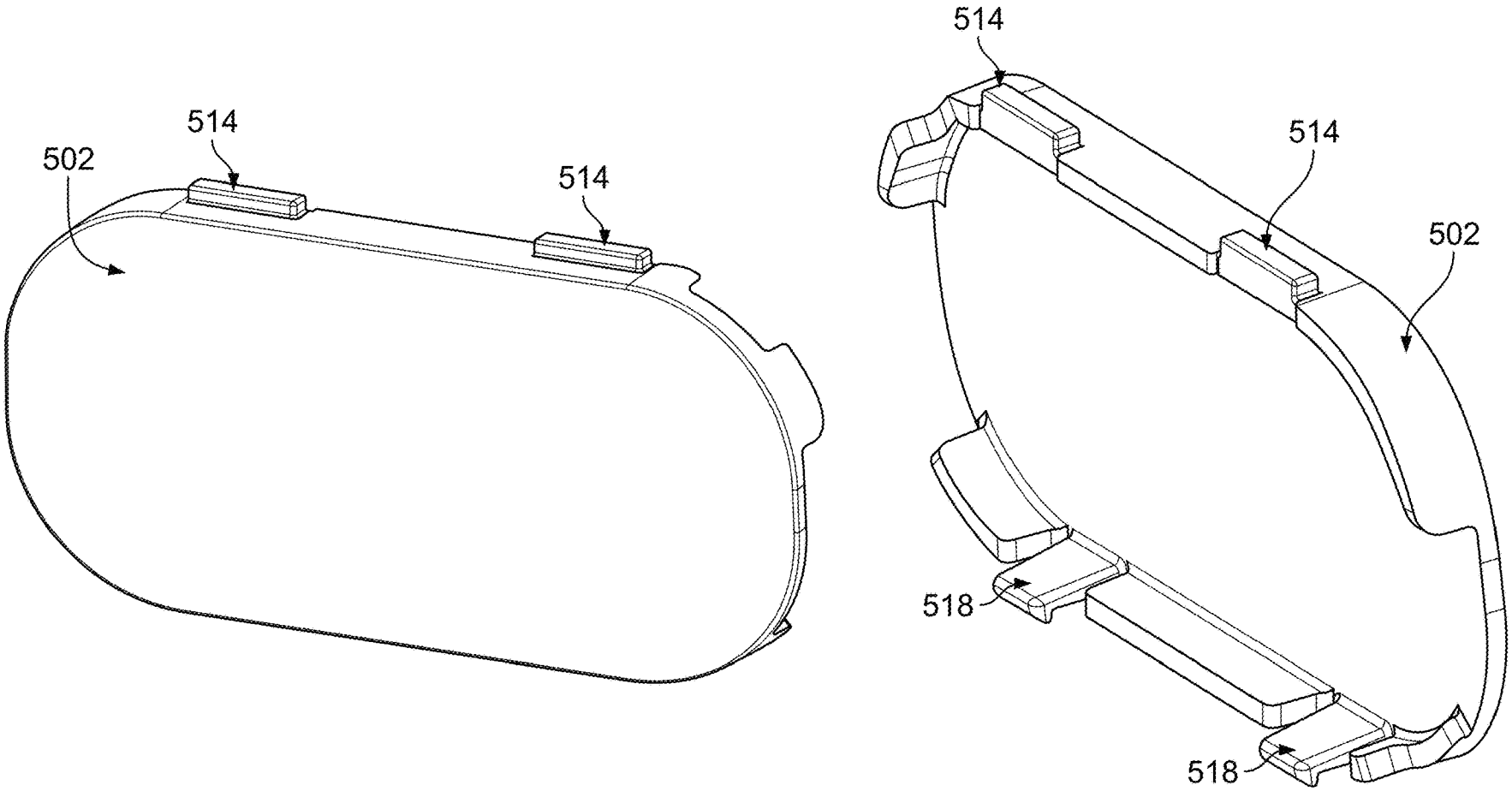
Figure 24D:
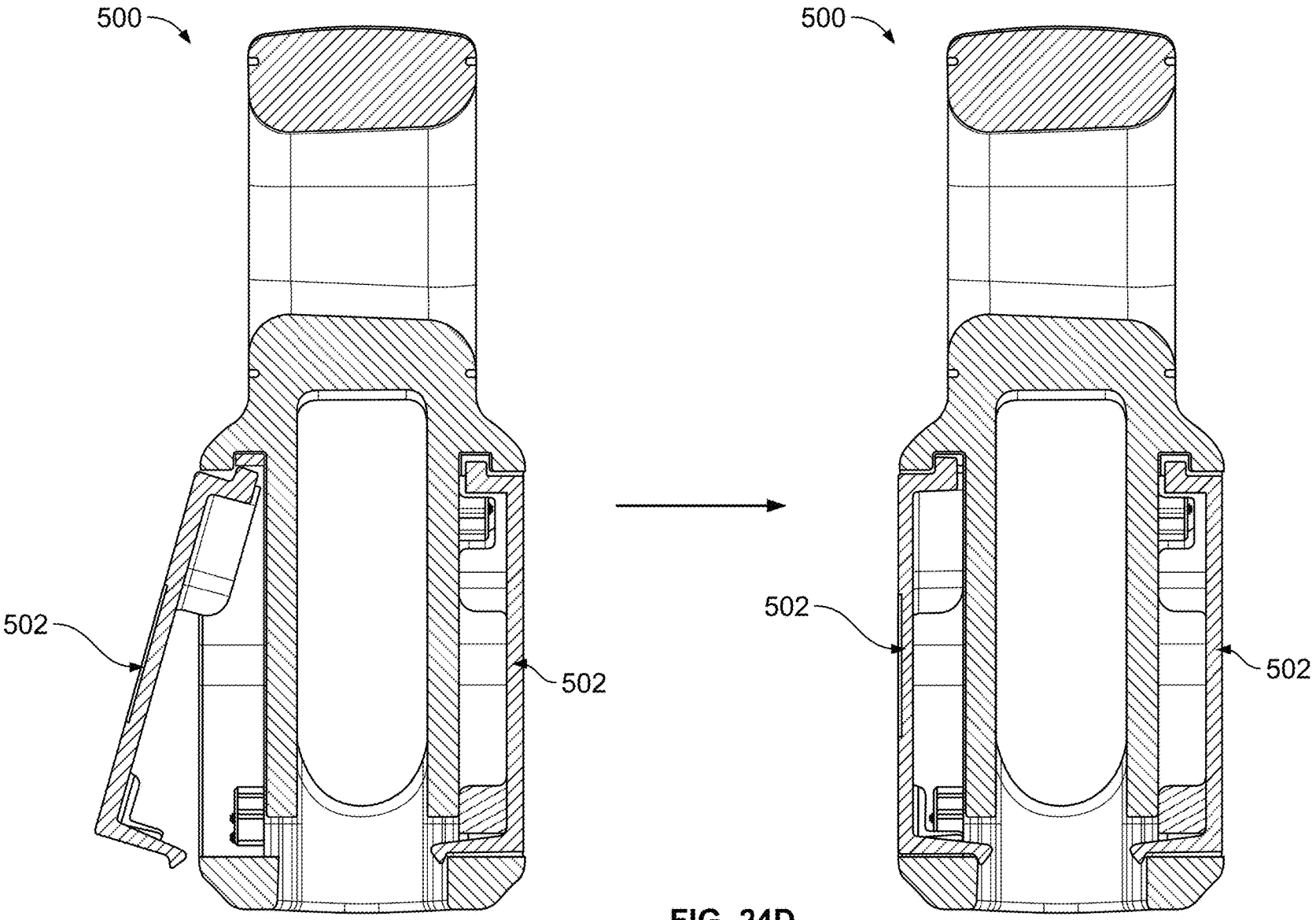
Figure 25B:
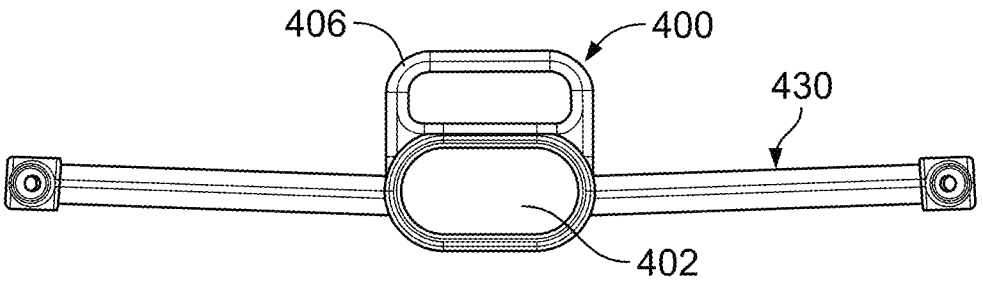
FIGS. 25A and 25B illustrate engagement of the rear tensioner when the user pushes down on the rear tensioner handle and increases the force until the rear tensioner goes over-center and hits an internal stop.
Figure 25A:
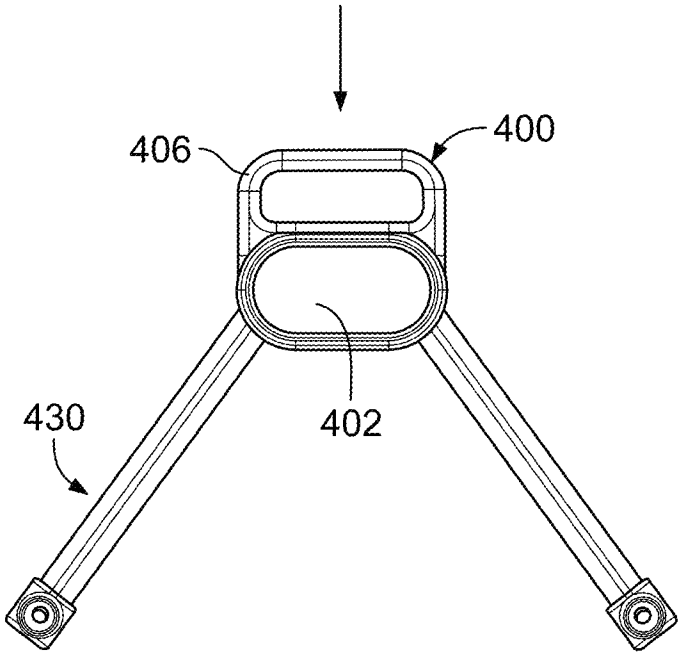

FIGS. 24B-24D illustrate another example rear tensioner 500. In one example, as shown in FIG. 24B, the rear tensioner 500 may include a handle 506, and rear tensioner covers 502*a* and 502*b*. Rear tensioner covers 502*a* and 502*b* may be shaped in a similar manner as the reservoir 512 (i.e., substantially oval or substantially rectangular shaped). In still other examples, the rear tensioner covers 502*a* and 502*b* include a plurality of flex fingers 518 configured at the bottom of the rear tensioner cover 502. The flex fingers 518 may also be configured to easily snap into the rear tensioner 500 to cover the reservoir 512. In other examples, the rear tensioner covers 502*a* and 502*b* may be configured with a plurality of top tabs 514. Top tabs 514 may be configured to engage upper recesses 516. In other examples, the flex fingers 518 may be configured to engage lower recesses 520. In other examples, the rear tensioner covers 502*a* and 502*b* may be attached to the rear tensioner 500 by placing the top tabs 514 into the upper recesses 516 and then rotating the rear tensioner covers 502*a* and/or 502*b* downward. The flex fingers 518 may then be snapped into lower recesses 520 thus securing the rear tensioner covers 502*a* and 502*b* to the rear tensioner 500, as shown in FIG. 24D. In certain examples, the rear tensioner covers 502*a* and 502*b* may be removed from the rear tensioner 500 by disengaging the flex fingers 518 from the lower recesses 520 (i.e., by using a screw driver or other device), then disengaging the top tabs 514 from the upper recesses 516, and then removing the rear tensioner covers 502*a* and 502*b*.

In one example, to engage the rear tensioner 400, the user simply presses downwardly on the rear tensioner handle 406 such that the pivot points 408, pins 410, and rear tensioner arms 430*a* and 430*b* force the rear X frame 146 outward so that the fabric 155 is tensioned in the backrest 104. The user increases the downward force until the rear tensioner 400 goes over-center and hits at least one internal stop 414. The stops 414 are internal to the rear tensioner 400 so that the user is not at risk of injuring a finger or other body part during engagement or disengagement of the rear tensioner. To disengage the rear tensioner 400, the user does the reverse of engagement process and pulls up on the handle 406. Initially the required force is high until the rear tensioner arms 430*a* and 430*b* pop over-center and the rear tensioner 400 is disengaged and the chair is in a folded configuration.

Figure 26B:
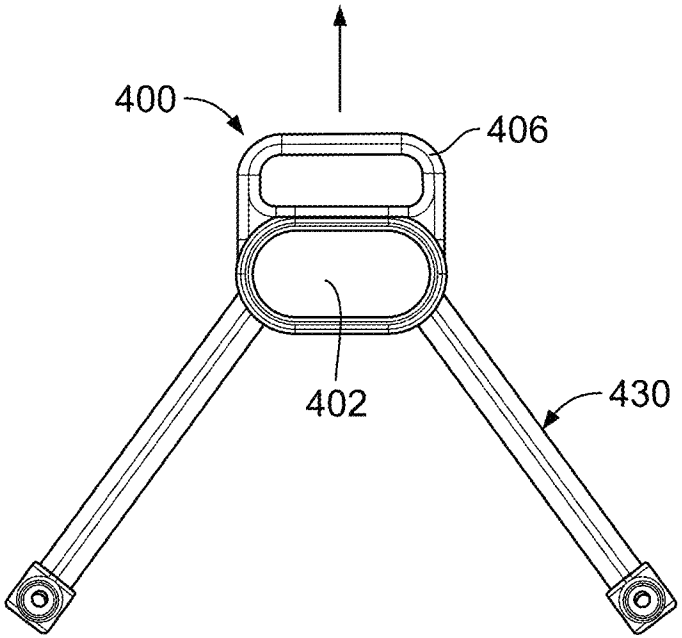
FIGS. 26A and 26B illustrate disengagement of the rear tensioner when the user pulls up on the handle until the tensioner is disengaged.
Figure 26A:
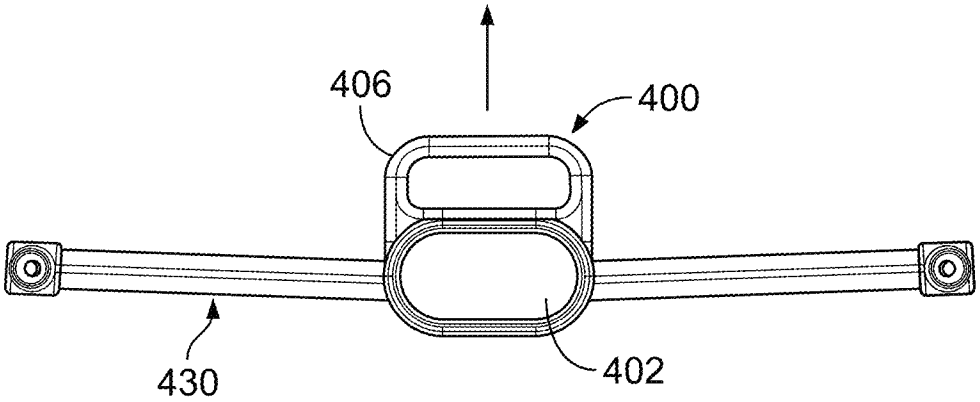
Figure 27:
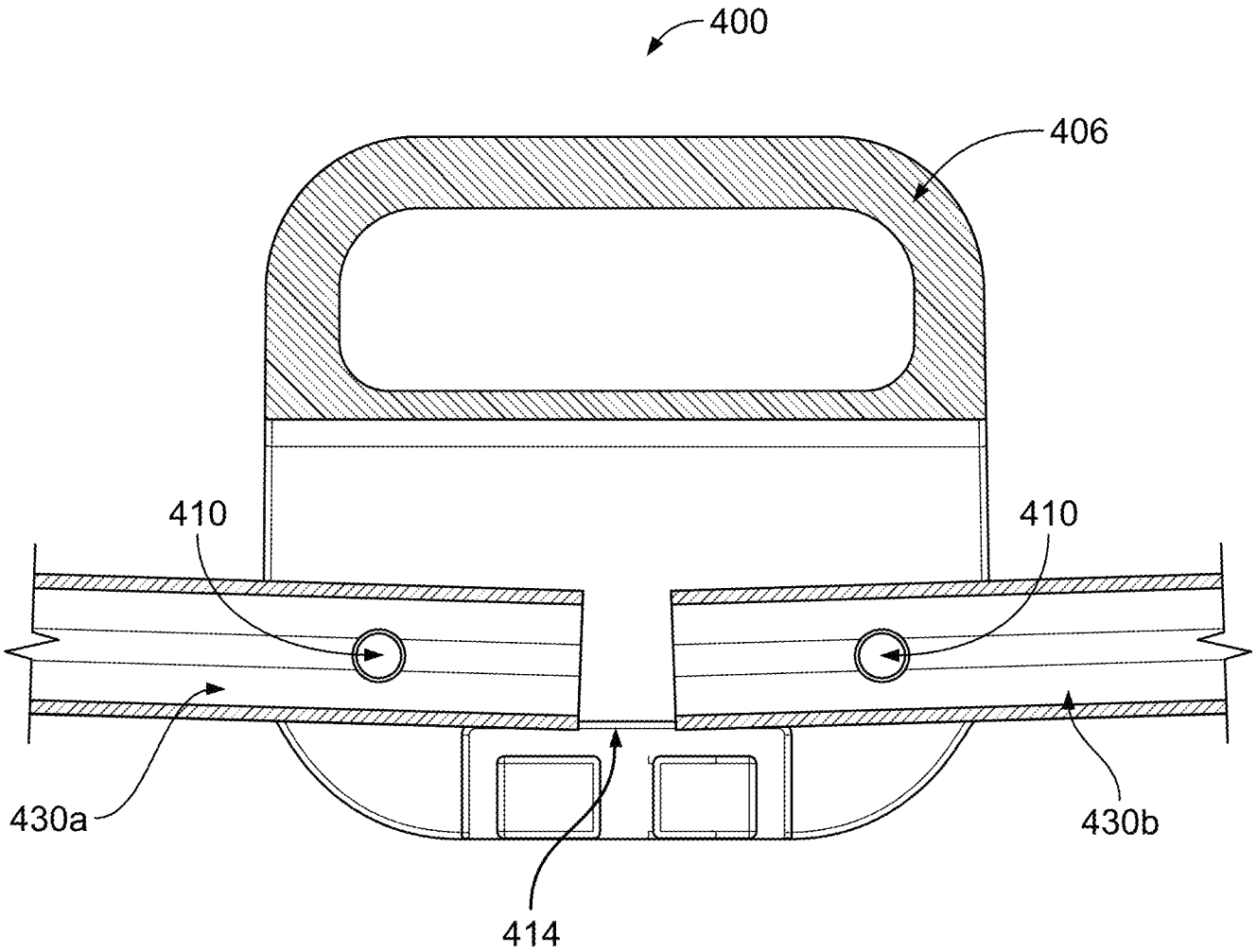
FIG. 27 illustrates a cross-section of the rear tensioner while under tension.

FIG. 27 illustrates a cross-section of the rear tensioner while under tension. The ends of the rear tensioner arms 430*a* and 430*b* engage stops 414 after the users applies the appropriate downward force on the rear tensioner handle 406 and the rear tensioner 400 goes over-center. When the rear tensioner 400 is engaged, an angle formed between the rear tensioner arms 430*a* and 430*b* is greater than 180 degrees as shown in FIG. 26A. When engaged with the stops 414, the arms 430*a* and 430*b* are in a substantially parallel position in relation to a top contact surface of the stops 414. Arms 430*a* and 430*b* are secured to the pivot points 408 and the rear tensioner 400 by pins 410. FIG. 28 illustrates the rear tensioner 400 in the disengaged or unfolded position. The rear tensioner arms 430*a* and 430*b* are substantially perpendicular to the top contact surface of the stops 414 when the rear tensioner is disengaged and in a substantially folded position. When the rear tensioner 400 is disengaged and in a substantially folded position, an angle formed between the rear tensioner arms 430*a* and 430*b* is less than 90 degrees and the rear tensioner arms 430*a* and 430*b* are substantially parallel as shown in FIG. 28.

Figure 29:
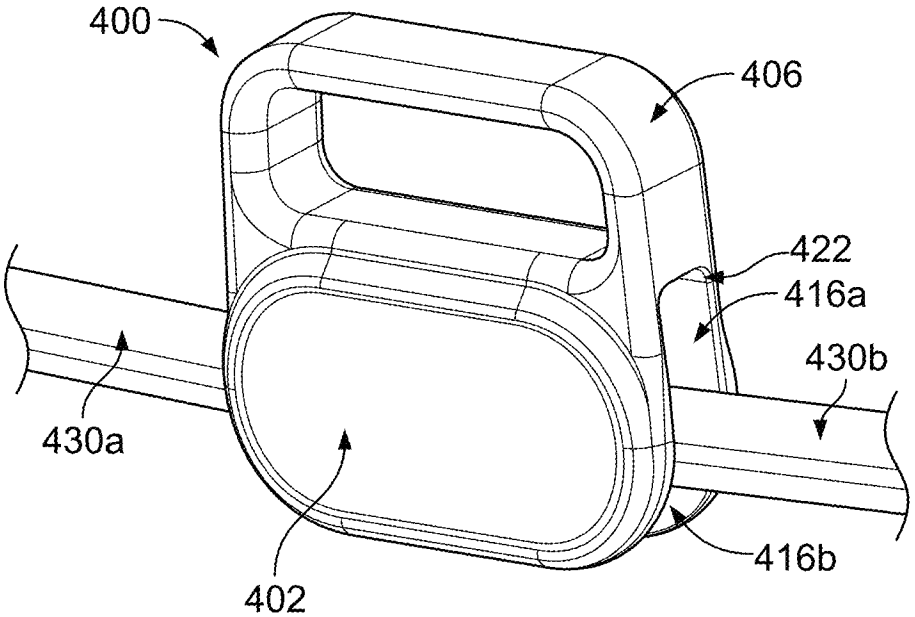
FIG. 29 illustrates a gap between the rear tensioner and the rear tensioner arms.

In other examples, as shown in FIG. 29, rear tensioner 400 includes safety gaps 416*a* and 416*b* below handle 406 at the top and in the underside of the rear tensioner 400. The gap 416*b* is sized so that the arms 430 does not pinch the user's skin or finger if their finger is between rear tensioner arms 430*a* and 430*b* and the tensioner 400. In some examples, the gap 416*b* may be at least 12 mm in width to prevent the pinching or crushing of an individual's finger or skin. In other examples, the gap 416*b* is approximately 12 mm in width. In other examples, the lower gap 416*a* is at least 5 mm in width. In still other examples, the gap 416*b* may be about 5 mm, 6 mm, 7 mm, 8 mm, 9 mm, 10 mm, 11 mm, 12 mm, 13 mm, 14 mm, or 15 mm in width. In some examples, the upper gap 416*a* allows a user's finger to be pushed out by the rear tensioner arms 430*a* and 430*b* when the tensioner is disengaged. The movement of the rear tensioner arms 430*a* and 430*b* forces an individual's finger out of gap 416*a* when the tensioner is disengaged thus preventing the user's finger or skin from getting squeezed or pinched. In still other examples, the upper wall of the handle 406 housing 422 below the grasping portion of the handle may be raised or extended in height thus creating a larger upper safety gap 416*a* to prevent pinching of the user's hand or fingers.

Figure 30A:
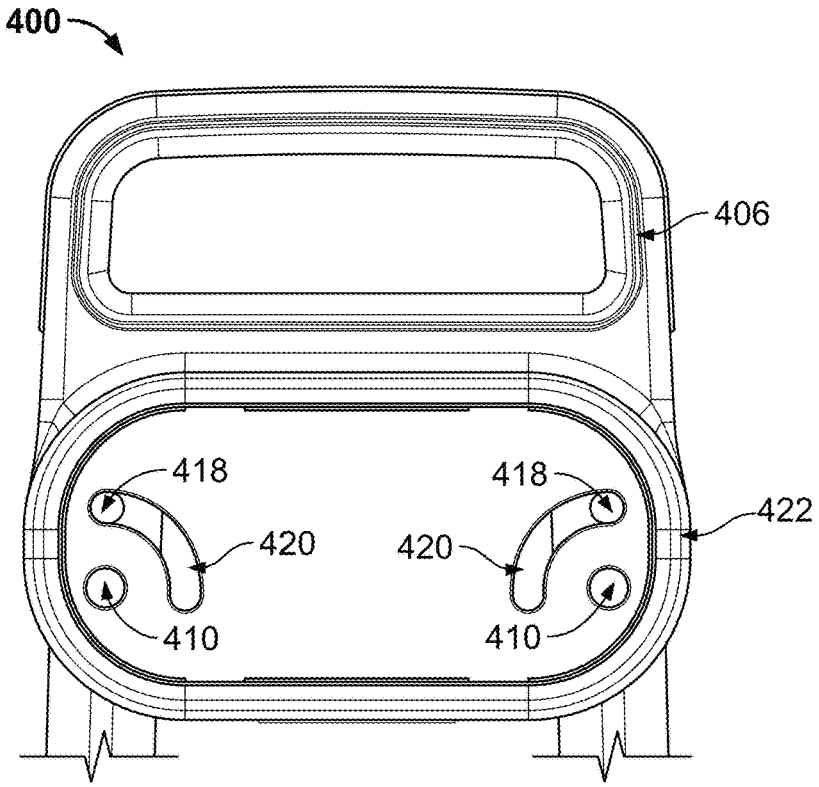
FIGS. 30A-30F illustrates another example rear tensioner.
Figure 30B:
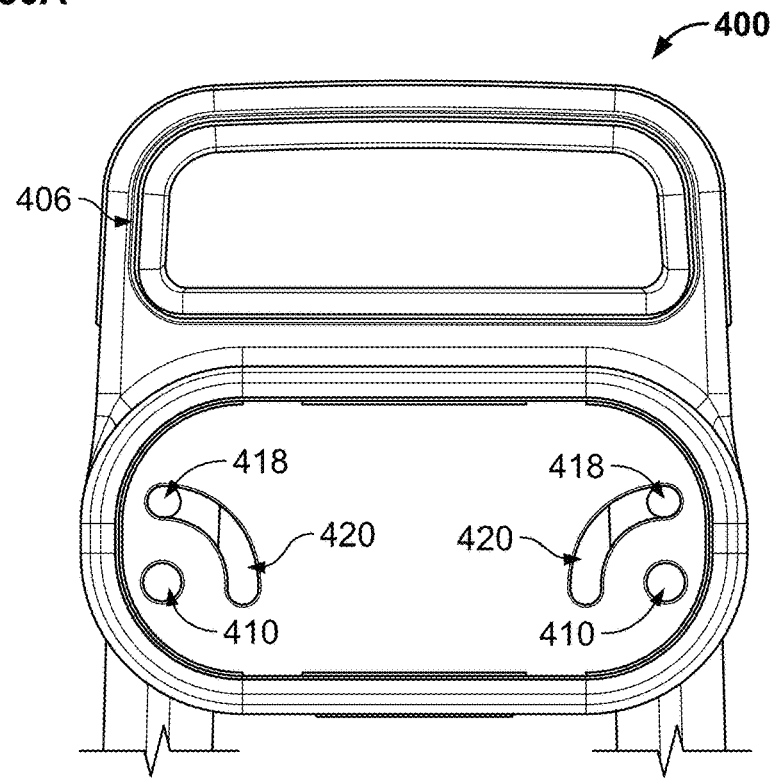
Figure 30C:
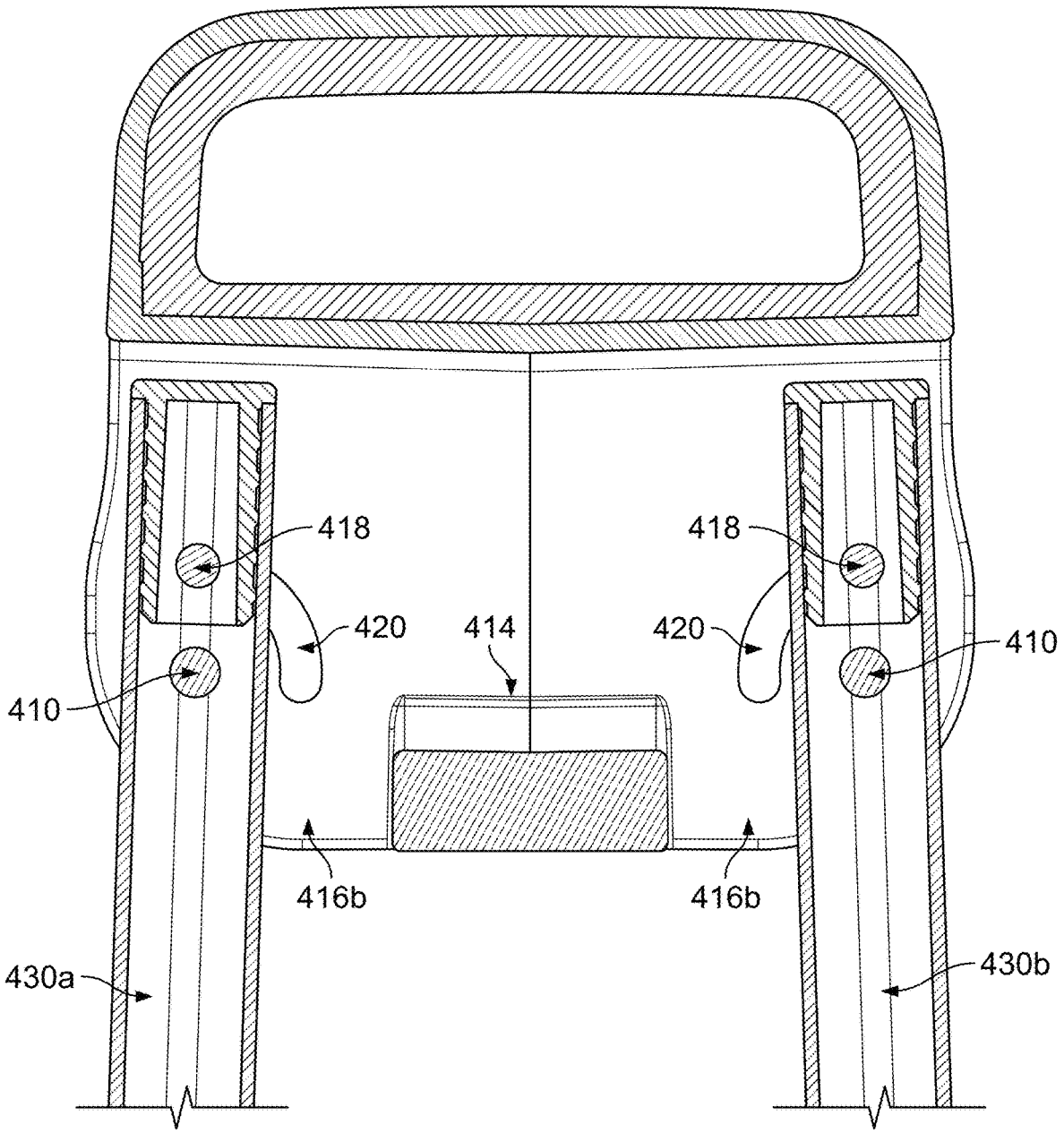
Figure 30D:
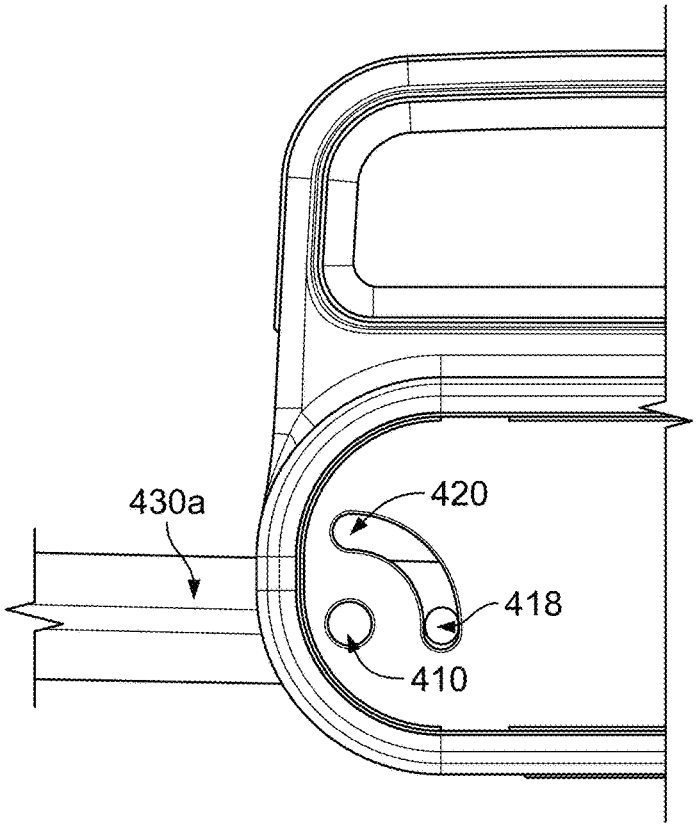
Figure 30E:
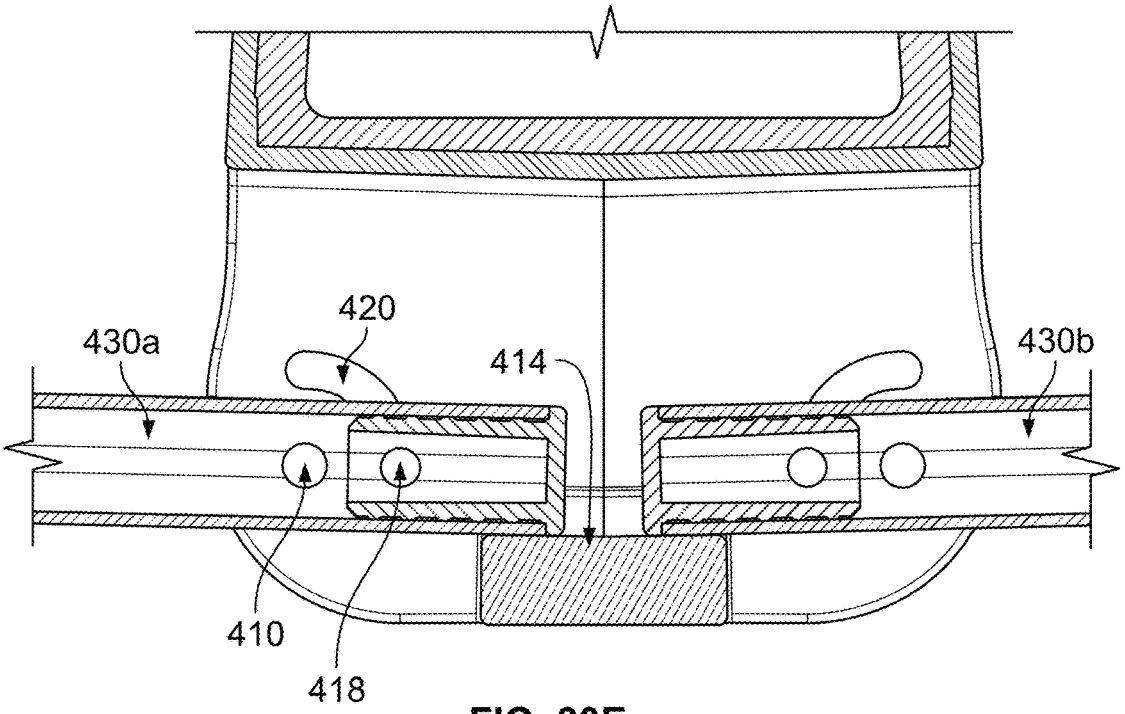
Figure 30F:
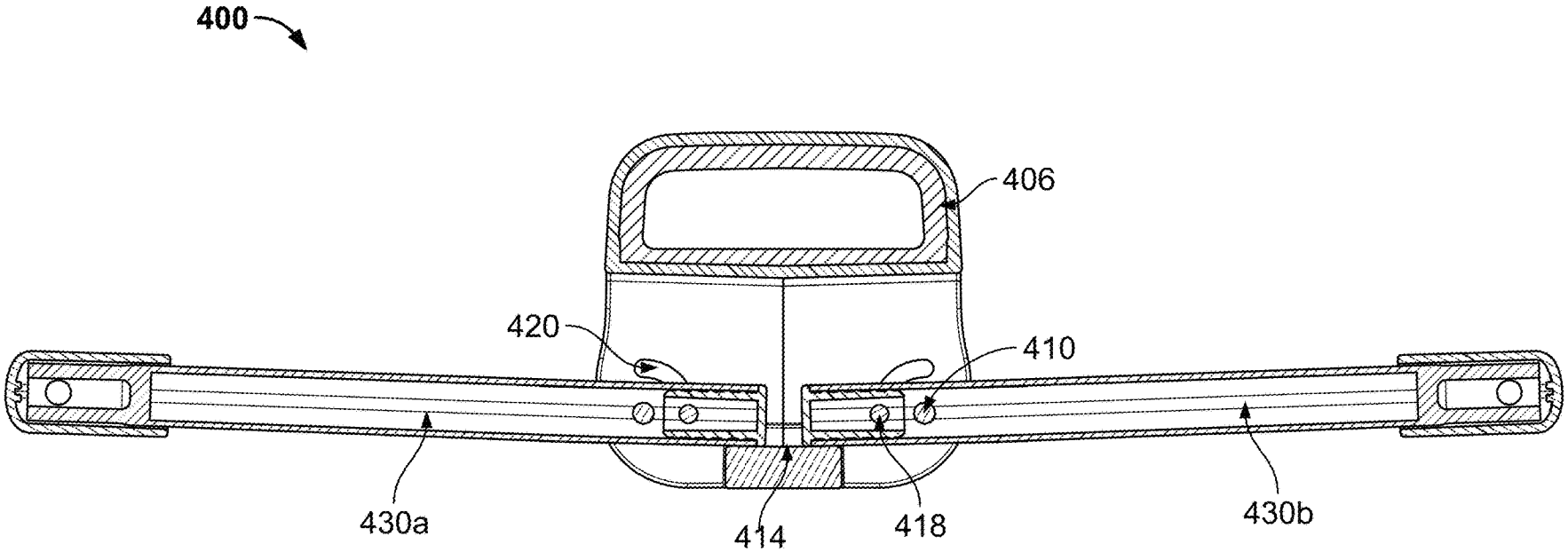

FIGS. 30A-30F illustrate another example rear tensioner 400. In some examples, as shown in FIGS. 30A and 30B, rear tensioner 400 may include a pair of slot rivets, projections, or cam 418 within the tensioner housing 422 configured to engage a pair of arcuate slots 420. The rear tensioner arms or arms 430*a* and 430*b* are connected to the rear tensioner via hold pins 410, which allow the rear tensioner arms to articulate or pivot on the rear tensioner. When the chair is in the folded position, as best shown in FIG. 30C, the rivets, cam, or projections 418 move to the end of the slots 420 which create stops to limit the travel of the rear tensioner arms 430*a* and 430*b*. As shown in FIG. 30C, the safety gap 416*a* provides clearance for a user's finger when the rear tensioner is in the folded position. As shown in FIGS. 30D, 30E, and 30F, when the rear tensioner is in the extended position to tension the suspension material of the chair, the ends of the rear tensioner arms 430*a* and 430*b*, guided by the slot rivets or projections 418 and the slots 420, are configured to engage stop 414. Stop 414 prevents further movement of the rear tensioner arms 430*a* and 430*b*. In the extended position, the elastic nature of the suspension fabric acts on the tensioner arms 430*a* and 430*b* to bias the ends of the tensioner tubes or arms 430*a* and 430*b* against the stop 414.

Figure 14:
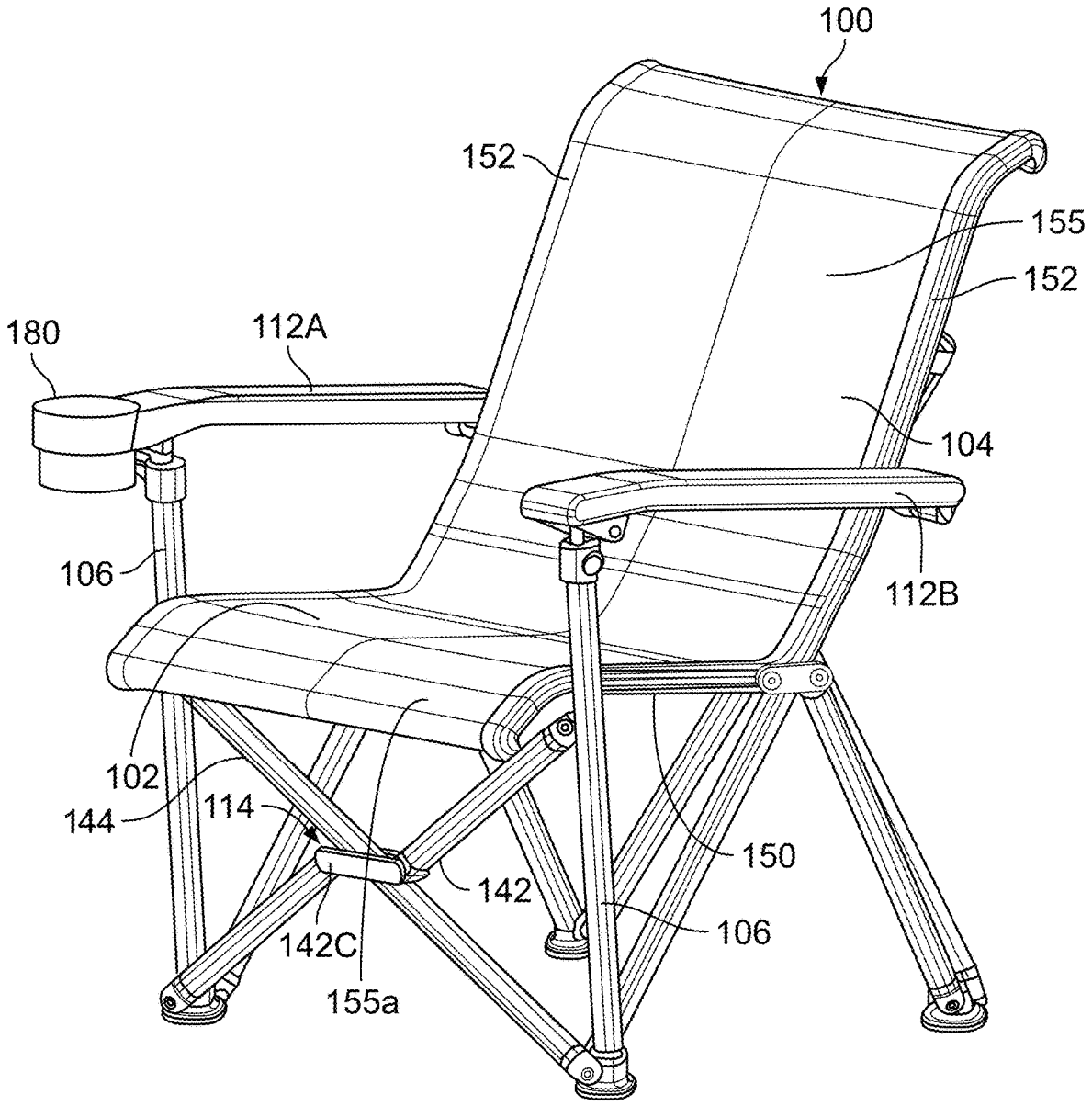
FIG. 14 shows another example folding chair formed with an integral cup holder.
Figure 31B:
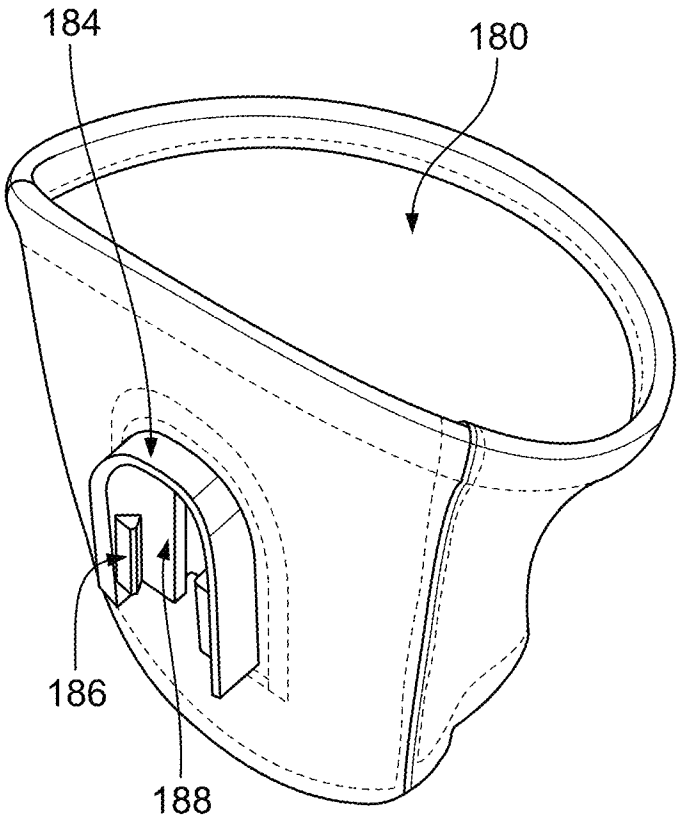
FIGS. 31A and 31B show another example folding chair formed with a removable and interchangeable cup holder.
Figure 31A:
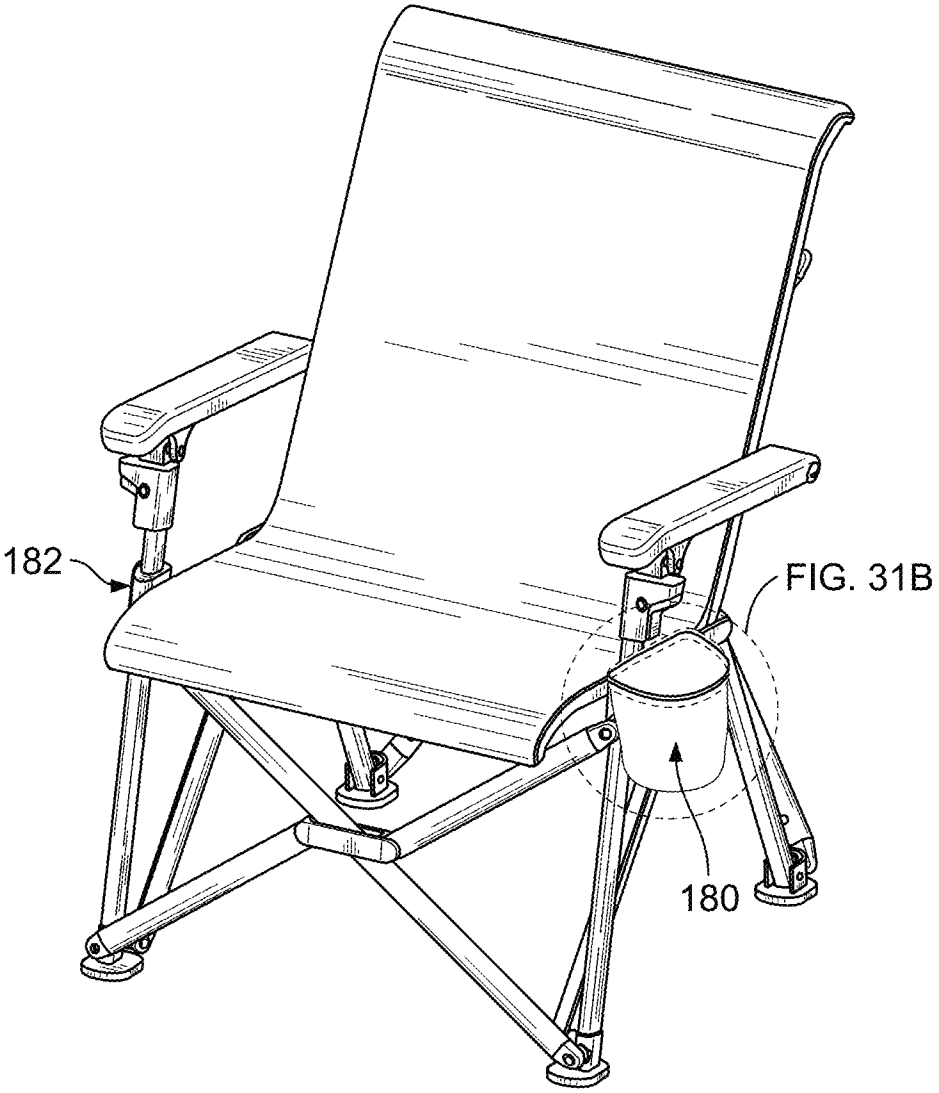
Figure 32C:
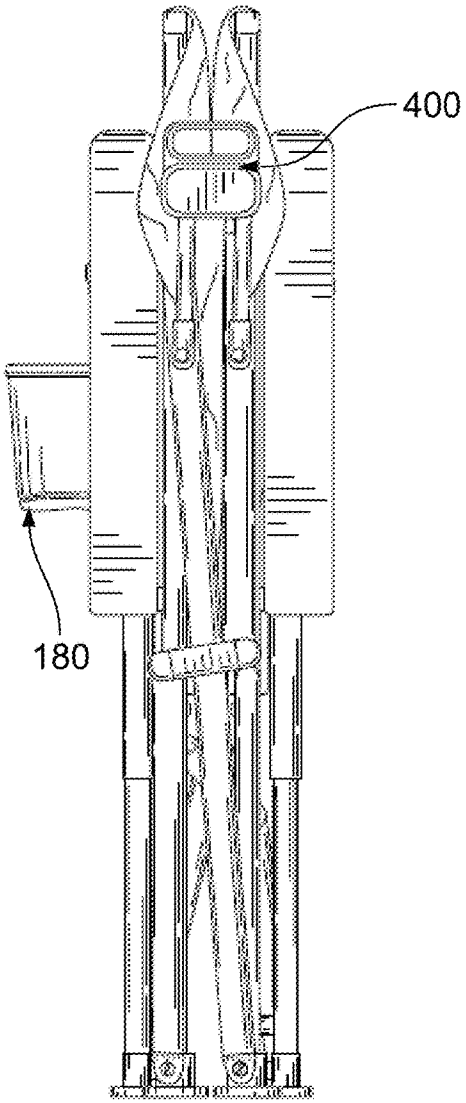
FIGS. 32A-32C show another example folding chair in the folded or stored configuration.
Figure 32B:
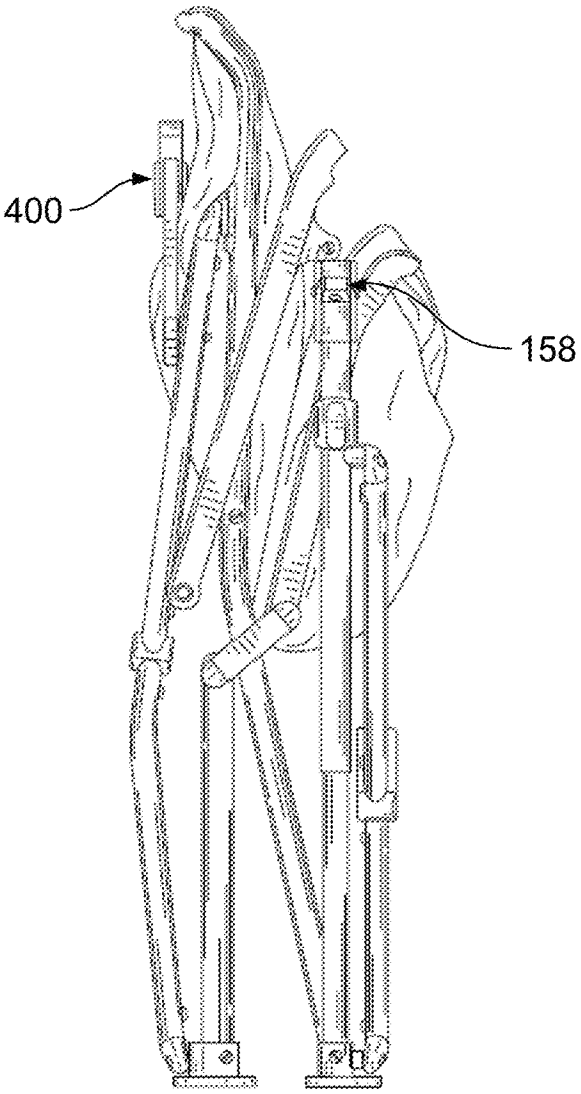
Figure 32A:
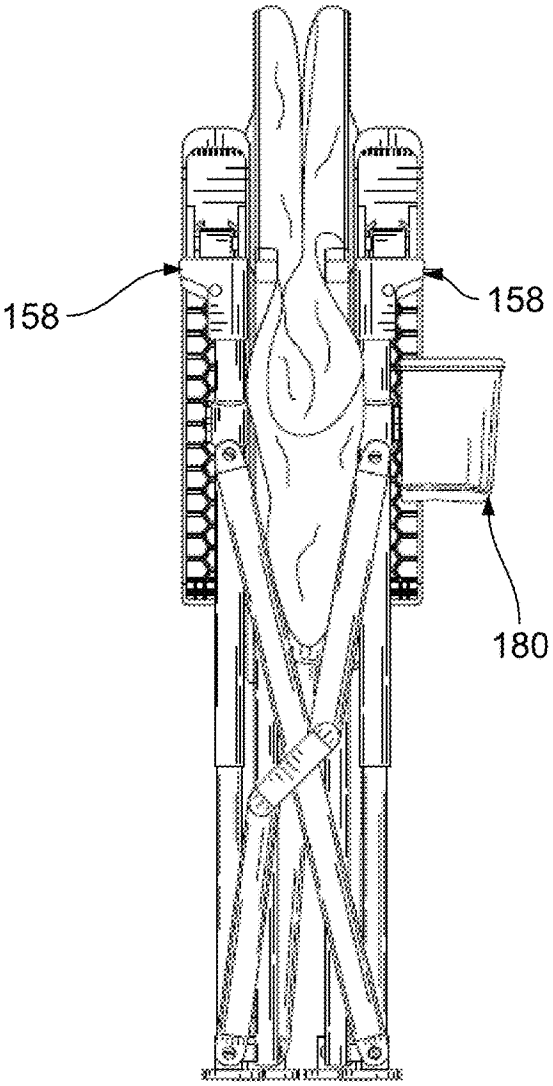

FIG. 31A illustrates another example folding chair with a cup holder 180. In other examples, the folding chair may include a removable cup holder 180 that is reversible or interchangeable from one side of the chair to the other. That is, the cup holder 180 may be swapped from arm rest 112A to 112B, and vice versa. In some examples, as shown in FIG. 31B, the removable cup holder 180 may further include a cup holder support 184 that attaches to a cup holder clip 182, as shown in FIG. 31A. Cup holder support 184 may be upside down u-shaped and may slide on to cup holder clip 182. In certain examples, the cup holder support 184 may include a plurality of guides 186 and a backing 188 that provide stability and are configured to engage cup holder clip 182. The guides 186 may slide into one or more depressions formed in the cup holder clip 182 securing the cup holder 180 to cup holder clip 182. The guides 186 may be elastic and configured to bias into the one or more depressions formed in the cup holder clip 182 to retain the cup holder 180 onto the chair. Yet, other examples are contemplated for securing the cup holder 180 onto the frame of the chair, such as other frictional type fits and mechanical fastening, such as barbed connections, ball and socket connections, threaded, adhesive, hook and loop, as well as other known methods. In other alternative examples, such as the exemplary chair shown in FIG. 14, the cup holder 180 is formed integral with the arm rests 112A and/or 112B.

In some examples, the cup holder support 184 may be sewn to a cup holder 180 or may be secured by adhesive, welding, or other technique well-known to those in the art. In still other examples, the cup holder support 184 may be integrally formed with the cup holder 180. In some examples, the cup holder clip 182 may be on the left or right side of the chair on the vertical leg(s) 106. In still other examples, the folding chair may include a plurality of cup holder clips 182 on each side of the vertical legs 106. In yet other examples, the cup holder 180 may be constructed of a canvas or nylon material. In still other examples, the cup holder 180 may be constructed of a hard molded plastic.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

The invention claimed is:

1. A folding chair comprising:

a seat pan being formed by a pair of seat bars, the seat pan being tensioned by a pair of vertical legs;

a backrest being formed by a pair of diagonally extending backrest bars;

a front frame formed by a pair of cross bars;

a rear frame formed by rear cross bars; and a pair of armrests;

wherein the seat pan and the backrest are formed of a suspension fabric wherein the suspension fabric has an overlap and a core placed into a hollow section created by the overlap and wherein the core in the hollow section is secured in a notch asymmetrically located in a top portion of the pair of diagonally extending backrest bars;

wherein the vertical legs are each provided with an inner leg and an outer leg and the inner leg is configured to telescope out of the outer leg;

wherein at least one of the vertical legs is provided with a latch for locking outer leg to the inner leg, the latch comprising a rocker and a projection configured to rotate the projection out of a slot formed on the inner leg, and wherein the latch further comprises a first biasing member for maintaining the projection in the slot of the inner leg.

2. The folding chair of claim 1 wherein the suspension fabric further comprises:

a first yarn;

a second yarn; and a thermoplastic polyurethane film;

wherein the first yarn is a polymer and the second yarn is more elastomeric than the first yarn;

wherein the thermoplastic polyurethane film is heat pressed to the first yarn and second yarn.

3. A folding chair comprising:

a seat pan being formed by a pair of seat bars, the seat pan being tensioned by a pair of vertical legs;

a backrest being formed by a pair of diagonally extending backrest bars;

a front frame formed by a pair of cross bars;

a rear frame formed by rear cross bars; and a pair of armrests;

wherein the seat pan and the backrest are formed of a suspension fabric;

wherein the vertical legs are each provided with an inner leg and an outer leg and the inner leg is configured to telescope out of the outer leg and at least one of the vertical legs is provided with a latch for locking the outer leg to the inner leg, the latch comprising a rocker and a projection configured to rotate the projection out of a slot formed in the inner leg;

wherein the backrest includes a tensioner configured to maintain the backrest in an unfolded position or a tensioned position, the tensioner comprising a rear tensioner handle, and a pair of rear tensioner arms.

4. The folding chair of claim 3 wherein the backrest suspension fabric has an overlap and a core placed into a hollow section created by the overlap wherein the suspension fabric further comprises:

a first yarn;

a second yarn; and a thermoplastic polyurethane film;

wherein the first yarn is a polymer and the second yarn is more elastomeric than the first yarn;

wherein the thermoplastic polyurethane film is heat pressed to the first yarn and second yarn.

5. The folding chair of claim 4 wherein the core in the hollow section is secured in a notch asymmetrically located in a top of the pair of diagonally extending backrest bars.

6. The folding chair of claim 3 wherein the tensioner further comprises at least one internal stop and a plurality of pivot points.

7. The folding chair of claim 6 wherein the tensioner is configured to move to the tensioned position when a user applies an increasing downward force to the rear tensioner handle until the tensioner exceeds an over-center point and contacts the internal stop and wherein the tensioner is retained in the tensioned position solely by the suspension fabric.

8. The folding chair of claim 6 wherein the tensioner is configured to disengage the tensioned position when a user applies an increasing upward force to the rear tensioner handle until the tensioner exceeds an over-center point and the tensioner is disengaged from the tensioned position into a folded position.

9. The folding chair of claim 3 wherein the tensioner further comprises a safety gap between a surface within the tensioner and one of the tensioner arms.

10. The folding chair of claim 9 wherein the tensioner arms each having a cam guided in slots defined in a tensioner housing and wherein during release of the tensioner the slots limit a movement of the tensioner arms to maintain the safety gap.

11. The folding chair of claim 9 wherein the tensioner is retained in the tensioned position solely by the suspension fabric.

12. The folding chair of claim 3 wherein when the tensioner is in the tensioned position, the pair of tensioner arms form a bottom angle greater than 180 degrees and a top angle less than 180 degrees.

13. The folding chair of claim 3 wherein the tensioner defines a housing having a pair of pivots for receiving the tensioner arms and wherein the pair of pivots are located internally within the housing such that the pivots are not exposed to a user.

14. The folding chair of claim 3 wherein the handle extends upward from the tensioner.

15. A folding chair comprising:

a seat pan being formed by a pair of seat bars, the seat pan being tensioned by a pair of vertical legs;

a backrest being formed by a pair of diagonally extending backrest bars;

a front frame formed by a pair of cross bars;

a rear frame formed by rear cross bars; and a pair of armrests;

wherein the seat pan and the backrest are formed of a suspension fabric;

wherein the backrest suspension fabric has an overlap and a core placed into a hollow section created by the overlap, and wherein the core in the hollow section is secured in an asymmetrical notch in a top of the pair of diagonally extending backrest bars;

wherein the suspension fabric overlap further includes a first yarn, a second yarn, and a thermoplastic polyurethane film wherein the first yarn is a polymer and the second yarn is more elastomeric than the first yarn and wherein the thermoplastic polyurethane film is heat pressed to the first yarn and the second yarn;

wherein the vertical legs are each provided with an inner leg and an outer leg and the inner leg is configured to telescope out of the outer leg and at least one of the vertical legs is provided with a latch for locking the outer leg to the inner leg, the latch comprising a rocker and a projection configured to rotate the projection out of a slot formed in the inner leg;

wherein the backrest includes a tensioner configured to maintain the backrest in an unfolded position or a tensioned position.

16. The folding chair of claim 15 wherein the tensioner comprises a pair of arcuate slots and a pair of arms each having a projection and wherein the arcuate slots limit a movement of the pair of arms such that the pair of arms and a surface within a housing define a safety gap on the tensioner.

17. The folding chair of claim 15 wherein the suspension fabric maintains the tensioner in the tensioned position.

18. The folding chair of claim 15 wherein the tensioner further comprises a pair of stops and wherein the suspension fabric solely biases the pair of arms against the pair of stops.

* * * * *